US010258866B2

(12) United States Patent
Melendez

(10) Patent No.: US 10,258,866 B2
(45) Date of Patent: Apr. 16, 2019

(54) INNOVATIVE CARD GAME

(71) Applicant: Joseph Luis Melendez, McKinney, TX (US)

(72) Inventor: Joseph Luis Melendez, McKinney, TX (US)

( * ) Notice: Subject to any disclaimer, the term of this patent is extended or adjusted under 35 U.S.C. 154(b) by 202 days.

(21) Appl. No.: 15/347,858

(22) Filed: Nov. 10, 2016

(65) Prior Publication Data

US 2017/0128819 A1 May 11, 2017

Related U.S. Application Data

(60) Provisional application No. 62/253,913, filed on Nov. 11, 2015.

(51) Int. Cl.
*A63F 1/00* (2006.01)
*A63F 1/04* (2006.01)

(52) U.S. Cl.
CPC ..... *A63F 1/00* (2013.01); *A63F 2001/0441* (2013.01)

(58) Field of Classification Search
CPC ..... A63F 1/00
See application file for complete search history.

(56) References Cited

U.S. PATENT DOCUMENTS 4,940,239 A * 7/1990 Tuttle ..... A63F 3/04 273/243
5,662,332 A * 9/1997 Garfield ..... A63F 1/00 273/308
6,354,594 B1 * 3/2002 Priester ..... A63F 1/00 273/298
6,375,566 B1 * 4/2002 Yamada ..... A63F 1/00 273/308
6,412,779 B1 * 7/2002 Kenney ..... A63F 1/04 273/274
7,216,870 B1 * 5/2007 Bess ..... A63F 1/00 273/292
7,665,733 B1 * 2/2010 Swanson, Sr. ..... A63F 3/001 273/243
2002/0017758 A1 * 2/2002 Buono ..... A63F 3/00157 273/292
2002/0180153 A1 * 12/2002 Casey ..... A63F 3/00031 273/298

(Continued)

*Primary Examiner* — James S. McClellan
*Assistant Examiner* — Kevin M Carter
(74) *Attorney, Agent, or Firm* — Eugenio J. Torres-Oyola; Victor M. Rodriguez-Reyes; Rafael Rodriguez-Muriel

(57) ABSTRACT

The present invention includes a deck of playing cards for playing a card game comprising a plurality of spell cards and a plurality of trap cards. The spell cards are for offensive use by a player to inflict consequences to the player's opponent while the trap cards are for defensive use by a player to mitigate consequences of the spell cards. The spell cards and trap cards are intended to be combined and mixed into a single deck and then divided into player decks and distributed between the players. However, the use of spell cards is limited by a mana resource cost associated with each card and a corresponding mana resource availability of a spell caster desiring to use the spell cards. A plurality of cards in each player deck are removed from their respective player decks and used by each player to indicate available mana resources and exhausted mana resources.

30 Claims, 29 Drawing Sheets

(56) References Cited

U.S. PATENT DOCUMENTS

| | | | | |
|---|---|---|---|---|
| 2005/0093229 | A1* | 5/2005 | Dewayne | A63F 1/00 273/146 |
| 2005/0151320 | A1* | 7/2005 | Gress | A63F 1/00 273/292 |
| 2006/0033273 | A1* | 2/2006 | Borne | A63F 3/00 273/243 |
| 2006/0038349 | A1* | 2/2006 | Meeks | A63F 1/04 273/308 |
| 2006/0249907 | A1* | 11/2006 | Wong | A63F 1/00 273/292 |
| 2008/0036150 | A1* | 2/2008 | Tucker | A63F 1/02 273/292 |
| 2008/0084028 | A1* | 4/2008 | Okos | A63F 3/00072 273/257 |
| 2009/0096169 | A1* | 4/2009 | Cox | A63F 1/00 273/308 |
| 2009/0179379 | A1* | 7/2009 | Banke | A63F 1/00 273/292 |
| 2010/0261519 | A1* | 10/2010 | Zapata | A63F 1/04 463/22 |
| 2010/0301561 | A1* | 12/2010 | Wong | A63F 1/00 273/292 |
| 2011/0237325 | A1* | 9/2011 | Hawkins, III | G06F 21/629 463/29 |
| 2013/0281173 | A1* | 10/2013 | Gilson | A63F 1/00 463/11 |
| 2014/0042698 | A1* | 2/2014 | Sek | A63F 1/00 273/292 |
| 2014/0327210 | A1* | 11/2014 | Gerard | A63F 1/00 273/308 |
| 2015/0251083 | A1* | 9/2015 | Wright | A63F 3/0457 273/242 |
| 2016/0220892 | A1* | 8/2016 | Coombe | A63F 1/18 |
| 2018/0028900 | A1* | 2/2018 | Montecillo | A63F 1/00 |

* cited by examiner

INNOVATIVE CARD GAME

STATEMENT REGARDING FEDERALLY SPONSORED RESEARCH AND DEVELOPMENT

N/A

FIELD OF THE INVENTION

The present disclosure pertains generally to card games, a unique deck of playing cards and a game that may be played using the unique deck of playing cards.

BACKGROUND OF THE INVENTION

A variety of card games have been developed over the years, and unique card decks have been developed for these purposes. One such genre of card games includes those based on the players wielding magical or other supernatural powers. However, typical games in this genre are "collecting card" games where players may begin with an initial set of cards, often dubbed a "starter pack." However, additional cards may be obtained by purchasing expansion packs which provide random cards that, if desired, may be substituted into the player's deck. While this system adds variation into any given game by providing for different combinations of cards to be accessible in each game, it introduces a different problem. By purchasing large quantities of expansion packs, a player may amass a powerful deck of cards which contributes more to the player's ability to win than chance or judgment in the duration of a game. In other words, winners and losers may be decided more based on the amount of money spent to acquire cards than on the skill with which players wield those cards. Other card games of this genre may include a "class" or "color" system that dictates the manner in which a deck may be constructed, adding additional complexity to a game that may make it less attractive to casual players. What is desired is a game which overcomes these and other deficiencies while still providing variation from one game to the next, but also relying more on chance and skill with the cards than just the financial ability to acquire more powerful cards.

SUMMARY OF THE INVENTION

The present invention includes a deck of playing cards for playing a card game comprising a plurality of spell cards and a plurality of trap cards. The spell cards are for offensive use by a player to inflict consequences to the player's opponent while the trap cards are for defensive use by a player to mitigate consequences of the spell cards. The spell cards and trap cards are intended to be combined and mixed into a single deck and then divided into player decks and distributed between the player. However, the use of spell cards is limited by a mana resource cost associated with each card and a corresponding mana resource availability of a spell caster desiring to use the spell cards. A plurality of cards in each player deck are removed from their respective player decks and used by each player to indicate available mana resources and exhausted mana resources.

BRIEF DESCRIPTION OF THE DRAWINGS

The accompanying drawings which are incorporated herein constitute part of the specifications and illustrate the preferred embodiment of the invention.

DESCRIPTION OF THE PREFERRED EMBODIMENT

Figure 1:
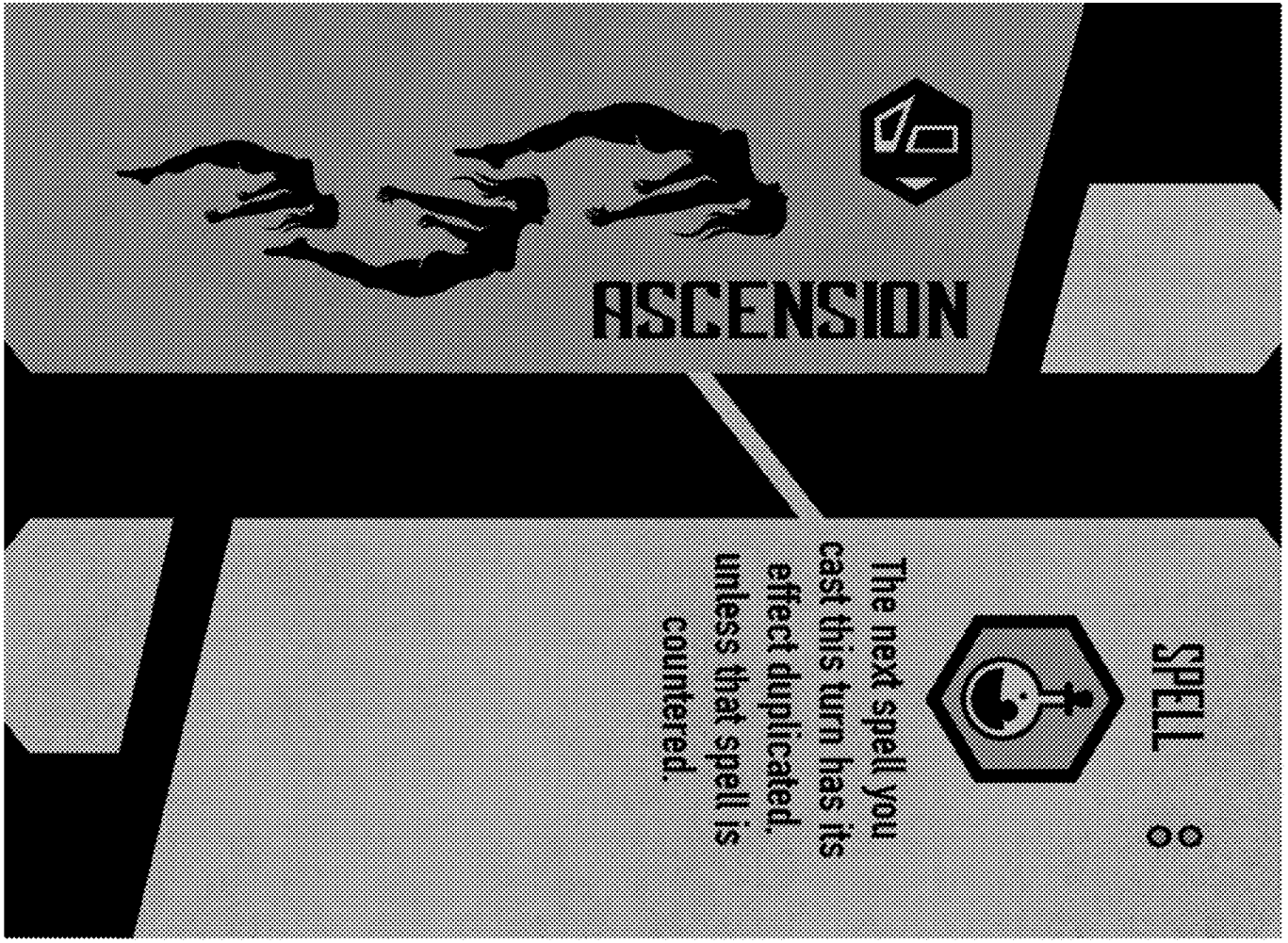
FIGS. 1-23 shows the spell cards that may be used during the game according to an exemplary embodiment.

The new and innovative deck of playing cards includes a plurality of spell cards and a plurality of trap cards. The spell cards are designed for offensive use by a player to inflict consequences to the player's opponent while the trap cards are designed for defensive use to mitigate consequences of, and in response to, played spell cards. Consequences of spell cards may include direct consequences, such as the removal of cards opponents may rely upon, or indirect consequences, such as the enhancement of available cards for use by the player utilizing the spell card. These types of spell card consequences are discussed in more detail below. According to an embodiment of the present invention, the spell cards and trap cards are combined and mixed into a single deck and then subsequently divided into two equal player decks and distributed between two players. For example, the two player decks could be formed by cutting the single deck of cards in half, or by dealing alternating cards or alternating groups of cards into two equal decks. Each player deck is intended drawn from by each respective player to form a player hand for each player. In addition, the deck of playing cards is designed so that a plurality of cards in each player deck are to be removed from their respective decks and used by each player to indicate the amount of available mana resources and exhausted mana resources. For example, according to an embodiment of the present invention, each player removes four cards from the bottom of their respective player decks to serve as indicators of available mana resources. Doing so randomly removes different cards from the available player decks, thereby changing the landscape of spells and traps available to each player upon each new game. Neither player gets to see which cards are in play as mana resources.

Mana resources are tracked and consumed as a resource for players to use to cast spells in the form of playing spell cards. According to an exemplary embodiment, the cards are placed face down on the playing surface and built up from zero, before the start of the first turn, to a total of four. Mana resources are exhausted when the player uses them to pay mana resource costs associated with the various spell cards, and they are refreshed at the beginning of each turn. Whether a mana resource is exhausted or not may be shown by altering the position of the face down card representing the mana resource on the table. For example, the player might keep the exhausted mana resources on the left, and the refreshed ones on the right. Exhausted mana resources are used up, and cannot provide mana again for additional spell casting until they become refreshed. Refreshing takes place automatically at the beginning of each turn, or may be achieved through spell casting as will be described later.

Each spell card specifies a designated number of required mana resources necessary to "cast" the described spell, and multiple spell cards may be played during an active player's turn, before the other player's turn begins, provided the active player maintains a sufficient amount of available mana resources to play a desired spell card. According to an embodiment of the invention, each spell card has one to four hexagonal symbol located in the upper left-hand side of the card. The number of these symbols is the mana resource cost needed to cast that spell card during a turn. Continuing with an embodiment of the invention, the objective of the game associated with the deck of cards is for each player to force his or her opponent into removing the cards from their player deck until the card game is concluded when one of the players has an insufficient number of cards in the player deck to initiate that player's turn. More detail on a method for playing a game with the deck is provided below, but first what follows is a description of the different types of spell and trap cards and exemplary spell cards in accordance with an embodiment of the invention. In the following discussion, a player who plays a spell card is referred to as a spell caster, and the player against whom a spell card is played (the opponent) is referred to as a spell recipient. Similarly, a player who plays a trap card is referred to as a trap caster, and the player against whom a trap card is played (the original spell caster) is referred to as a trap recipient. In this manner, a trap caster is also a spell recipient of the corresponding spell that preceded playing of the trap card. Similarly, a trap recipient is also the spell caster of the corresponding spell that preceded playing of the trap card.

Figure 3:
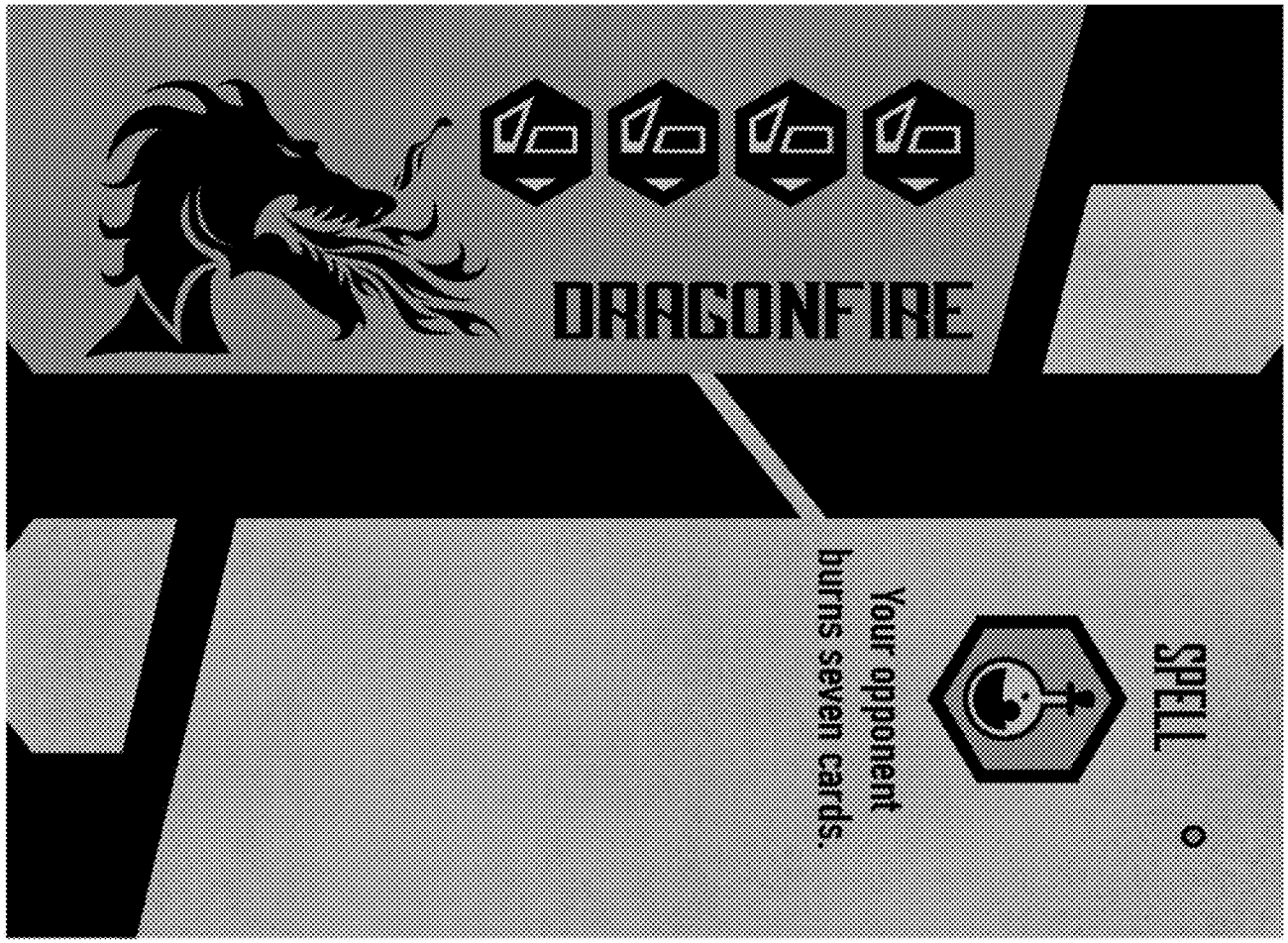
Figure 4:
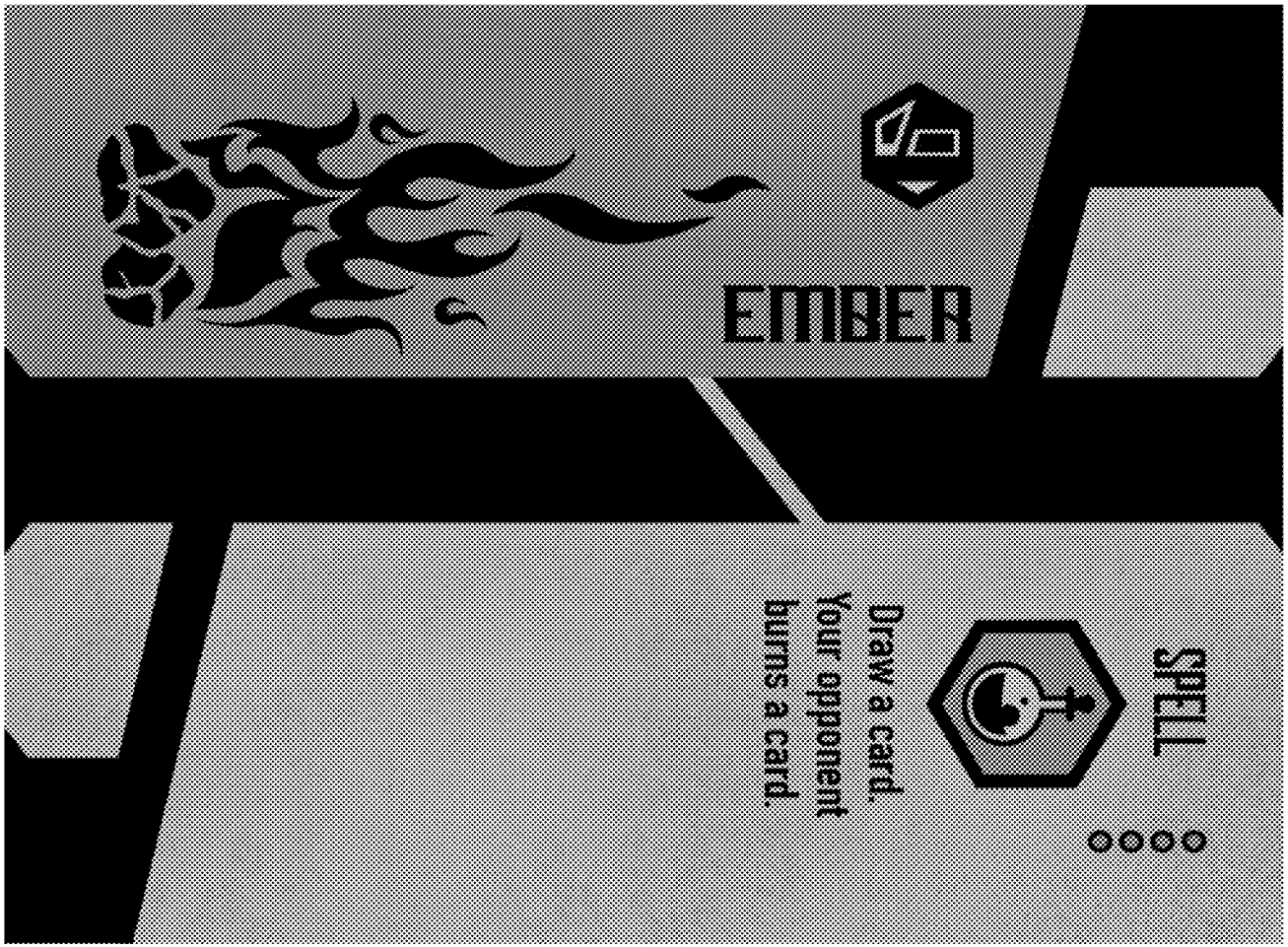
Figure 5:
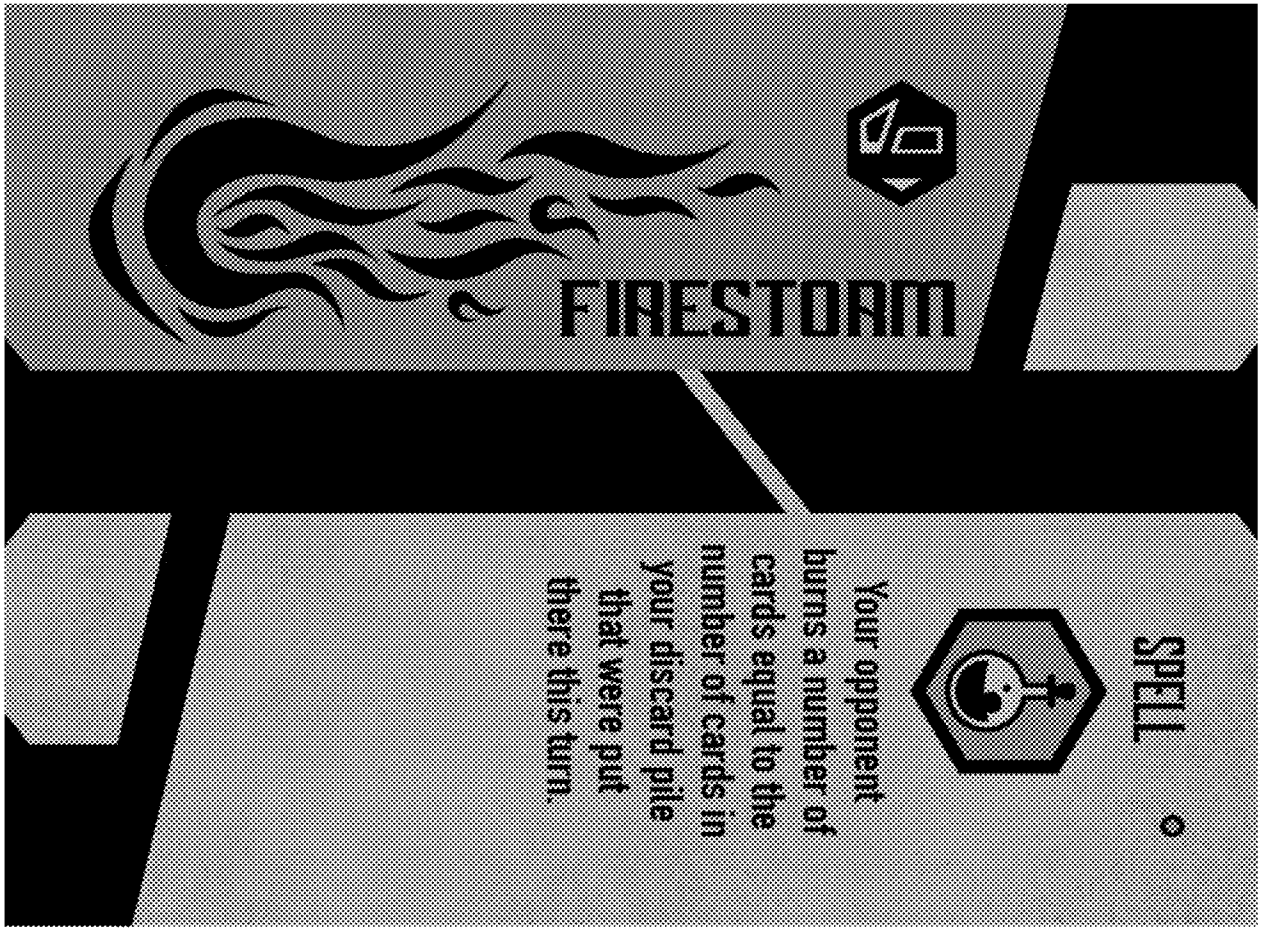
Figure 6:
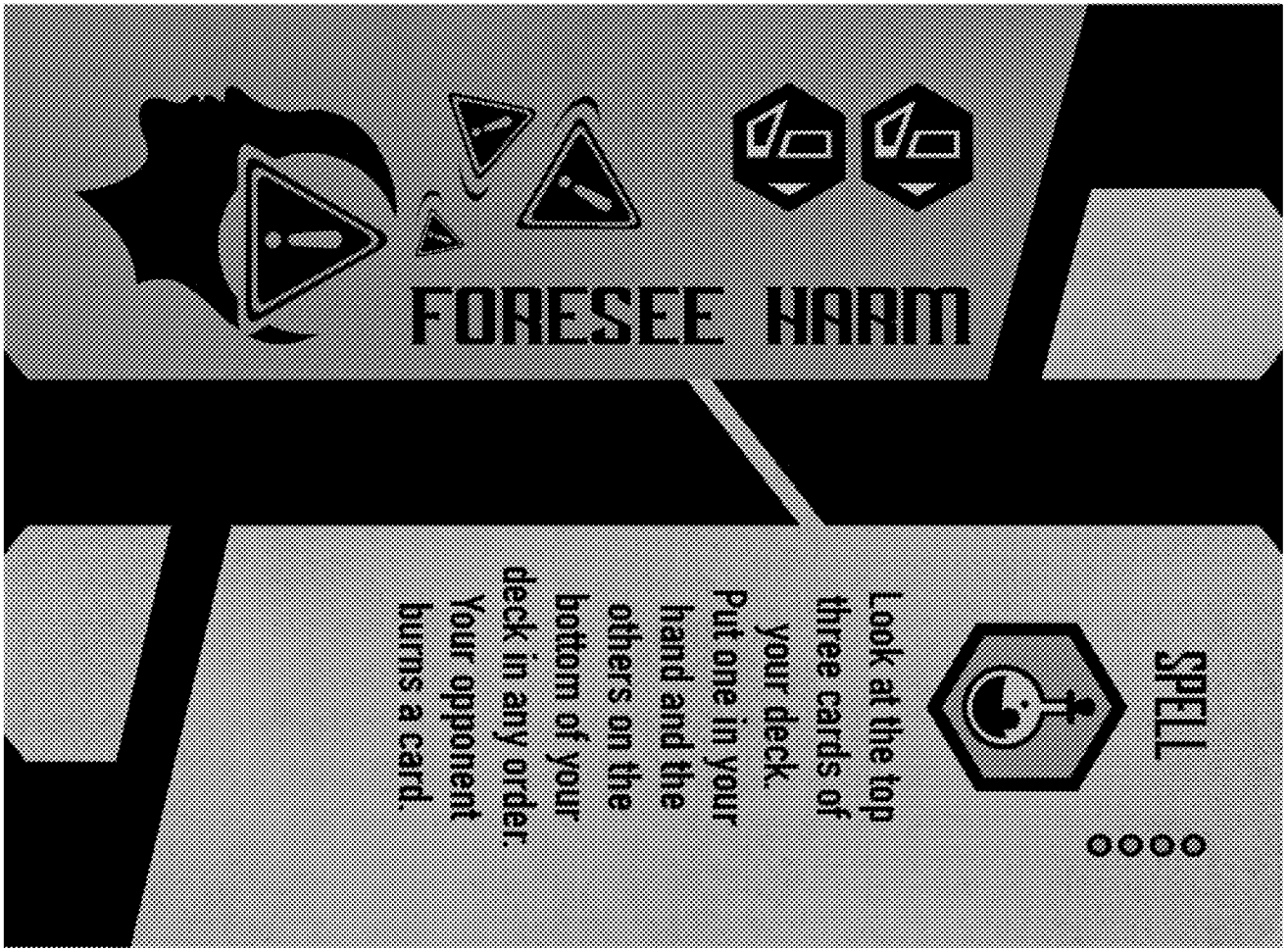
Figure 7:
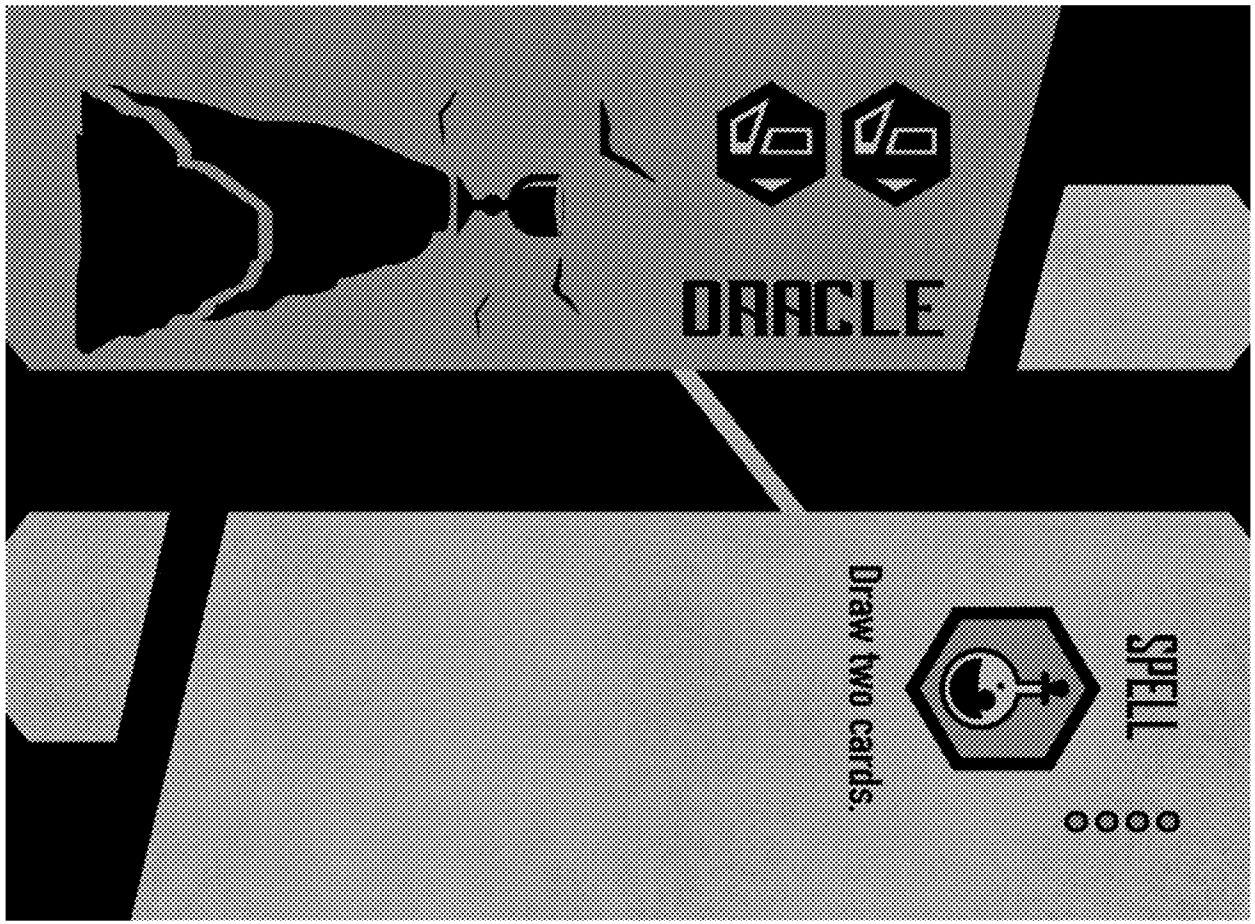
Figure 12:
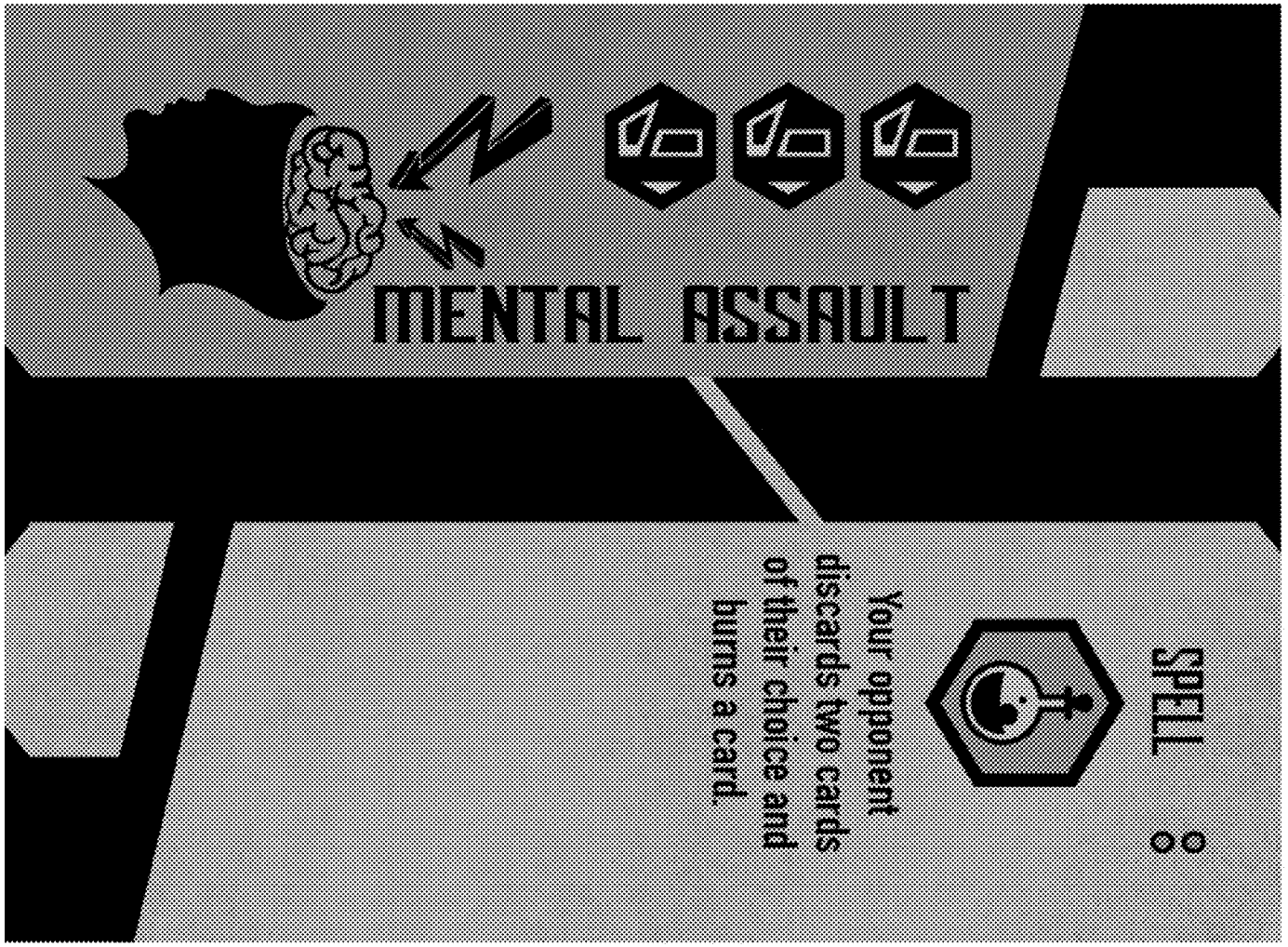
Figure 18:
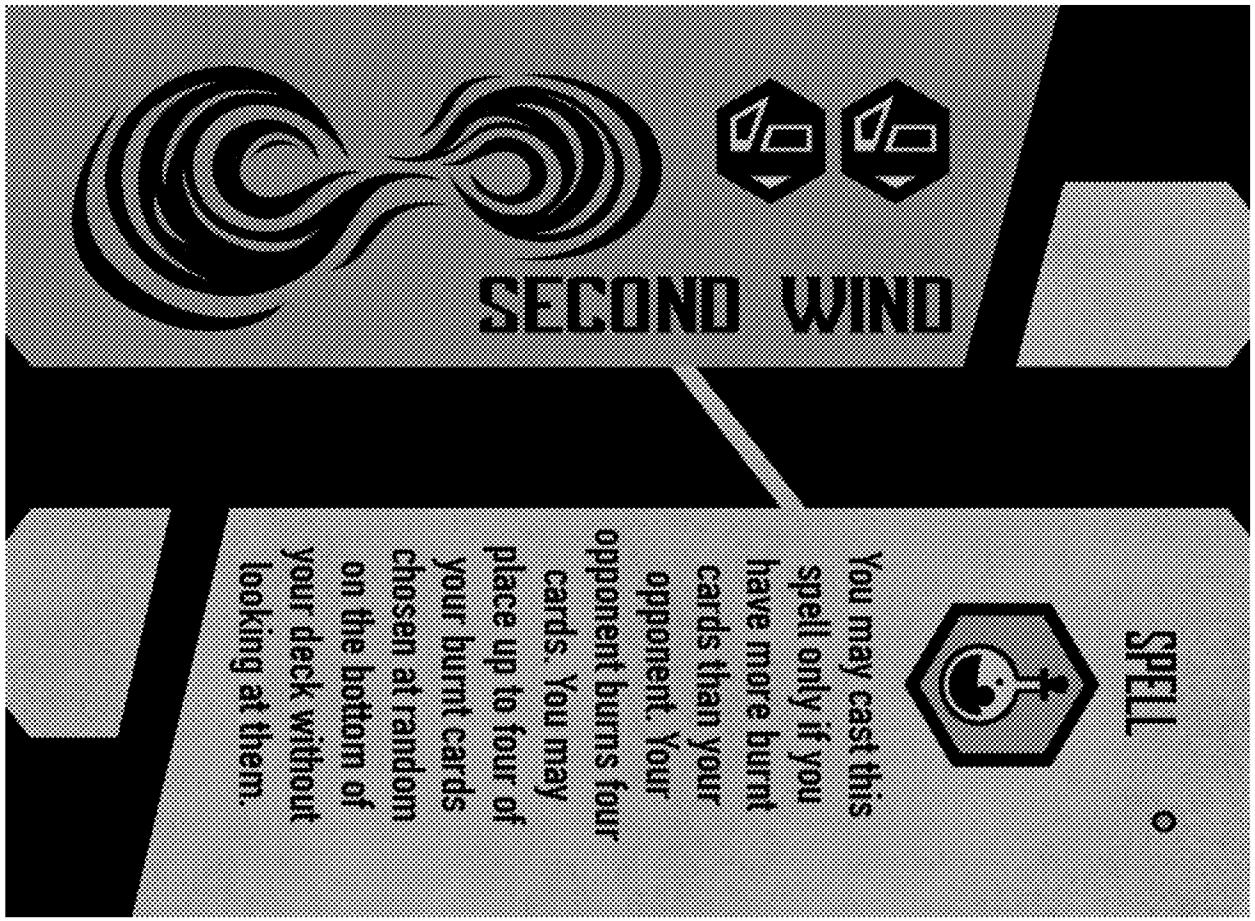
Figure 19:
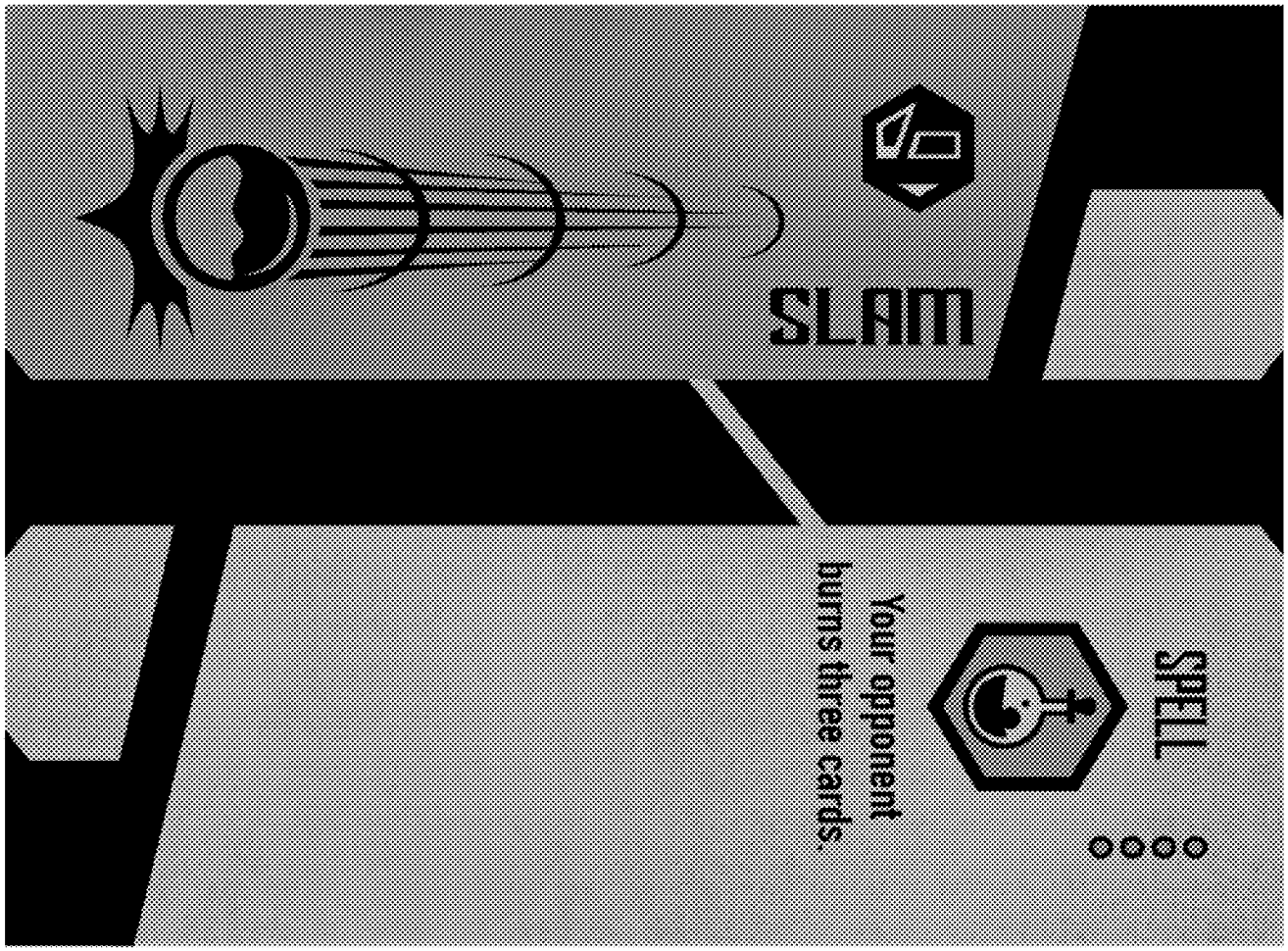
Figure 20:
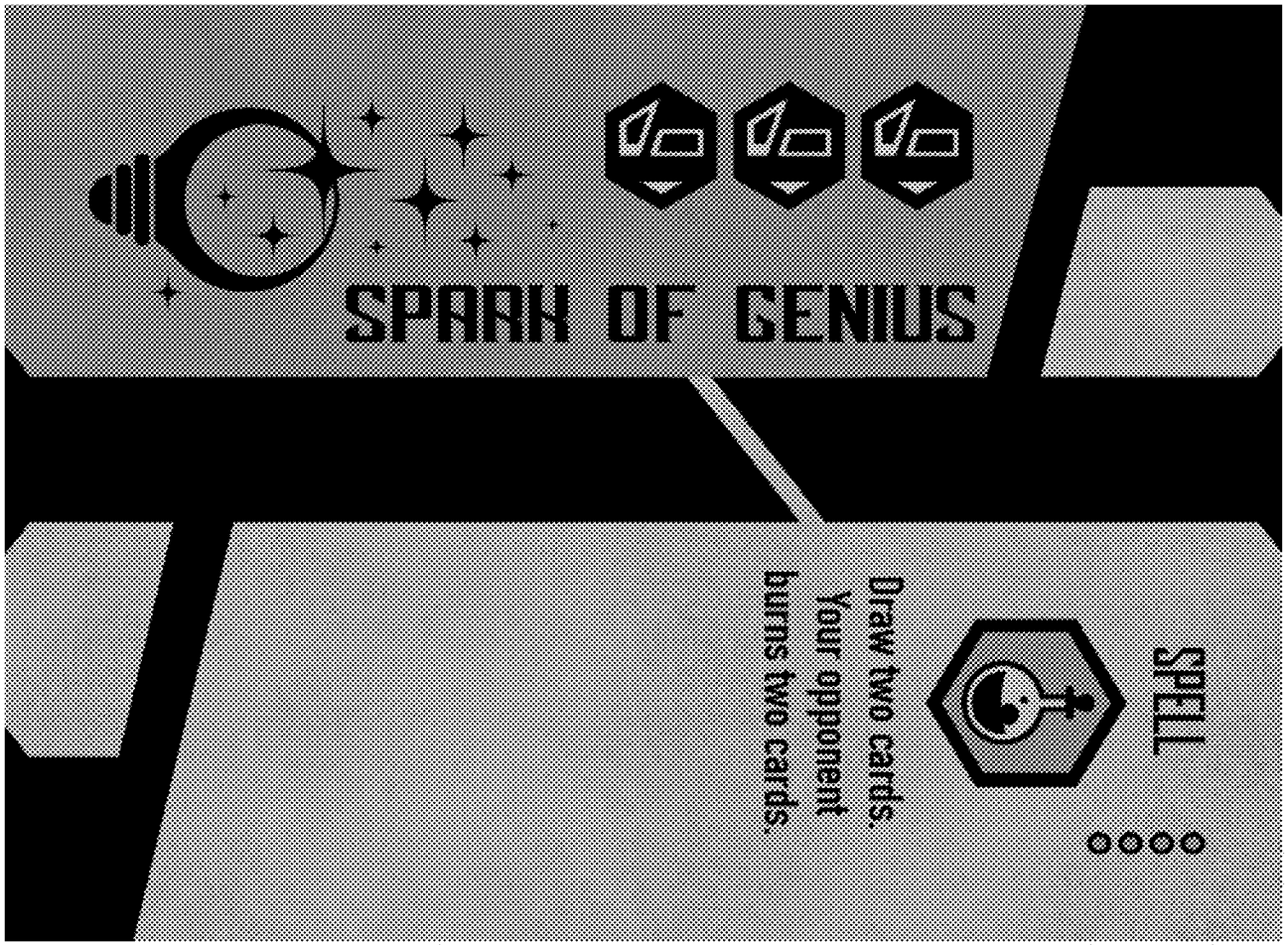

A "burning-type" spell card instructs the spell recipient to "burn" cards, which means to place at least one card from the player deck into a designated burn pile. The cards in the burn pile are not permitted to be used or drawn from for the duration of the game, absent specific instruction to the contrary. A similar effect to a burning-type spell card may be achieved by the spell caster placing any card in the deck face down, which is known as a "cinder." A cinder counts as a spell but imposes no mana resource cost onto the spell caster using it yet requires the spell recipient to burn one card from that player's player deck. To burn a card a recipient of a burning-type spell card or cinder must put the bottom card of his or her player deck into the burnt cards pile face down without looking at it. If the player required to burn a card has no cards in his or her player deck, the bottom card of the discard pile is burnt instead. The burnt cards pile is kept face down. The order of the burnt cards pile does not matter. Similarly, if a player is directed to "destroy" a card from his or her hand as the result of a spell or trap card, that card may be placed face down on top of the burnt cards pile. An exemplary embodiment includes a spell called "Dragonfire" as shown in FIG. 3, which instructs the spell recipient to burn seven cards. An exemplary embodiment also includes a spell called "Firestorm" as shown in FIG. 5, which instructs the spell recipient to burn a number of cards equal to the number of cards that were placed in the discard pile by the spell caster during the current turn. An exemplary embodiment also includes a spell called "Second Wind" as shown in FIG. 18, which instructs the spell recipient to burn four cards along with additional instructions discussed below. An exemplary embodiment also includes a spell called "Mental Assault" as shown in FIG. 12, which instructs the spell recipient to burn one card, along with additional instructions discussed below.

A "discarding-type" spell card instructs the spell recipient to place cards from the recipient's player hand into a discard pile of cards that are permitted to be used later in the duration of the game. Each player maintains his or her own discard pile and deposits any played spell or trap cards into it. The discard pile is distinguished from the burn pile as it is used subsequently to replenish the player deck once it has been exhausted. The role of the discard pile is discussed in more detail according to an exemplary embodiment of the invention below. If a player is directed to discard a card from his or her hand, the card may be placed on top of the discard pile face up. An exemplary embodiment includes a spell called "Mental Assault" as shown in FIG. 12, which instructs the spell recipient to discard two cards from the spell recipient's player hand by placing them in the discard pile along with other instructions previously discussed.

Figure 2:
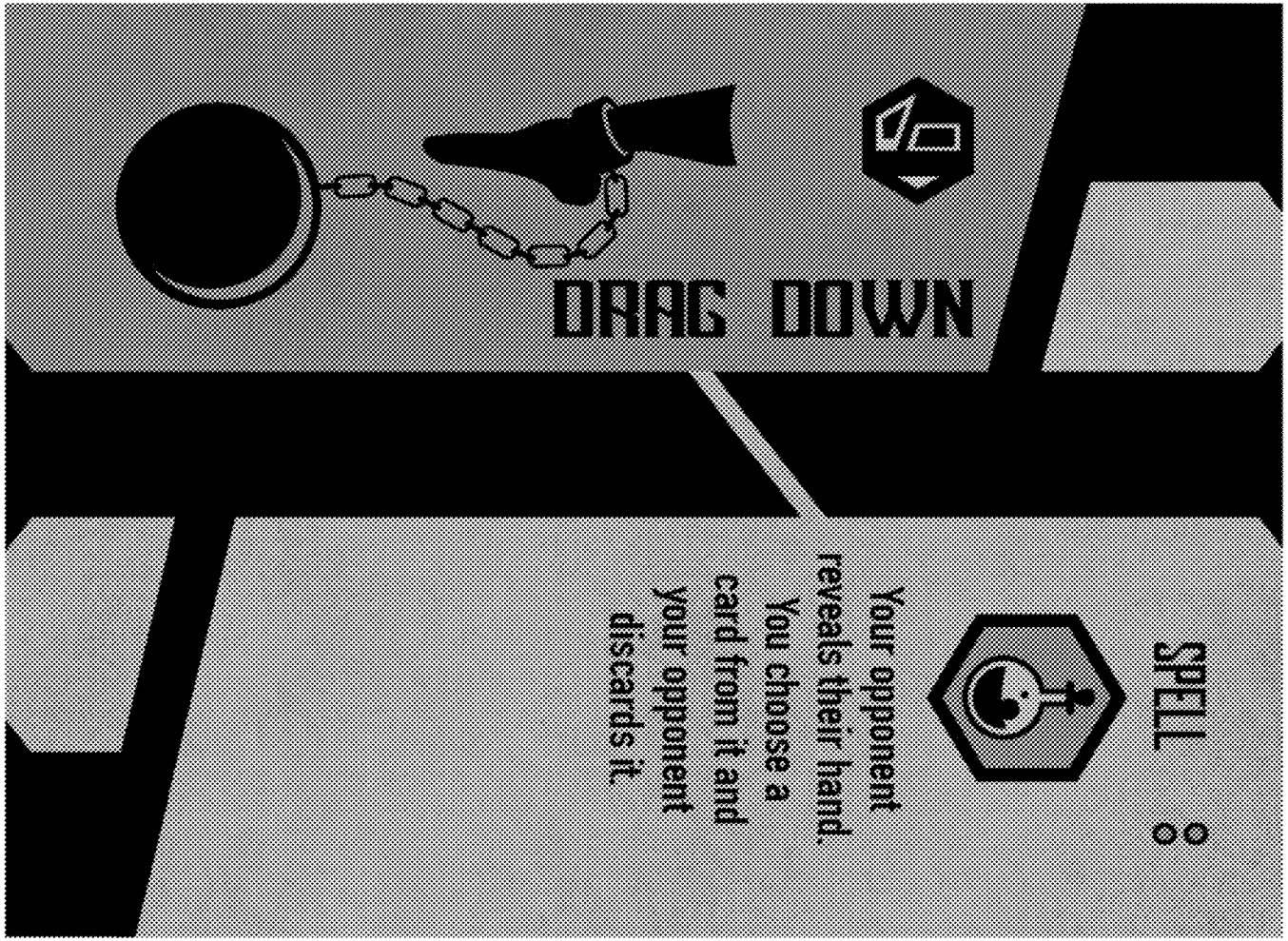
Figure 21:
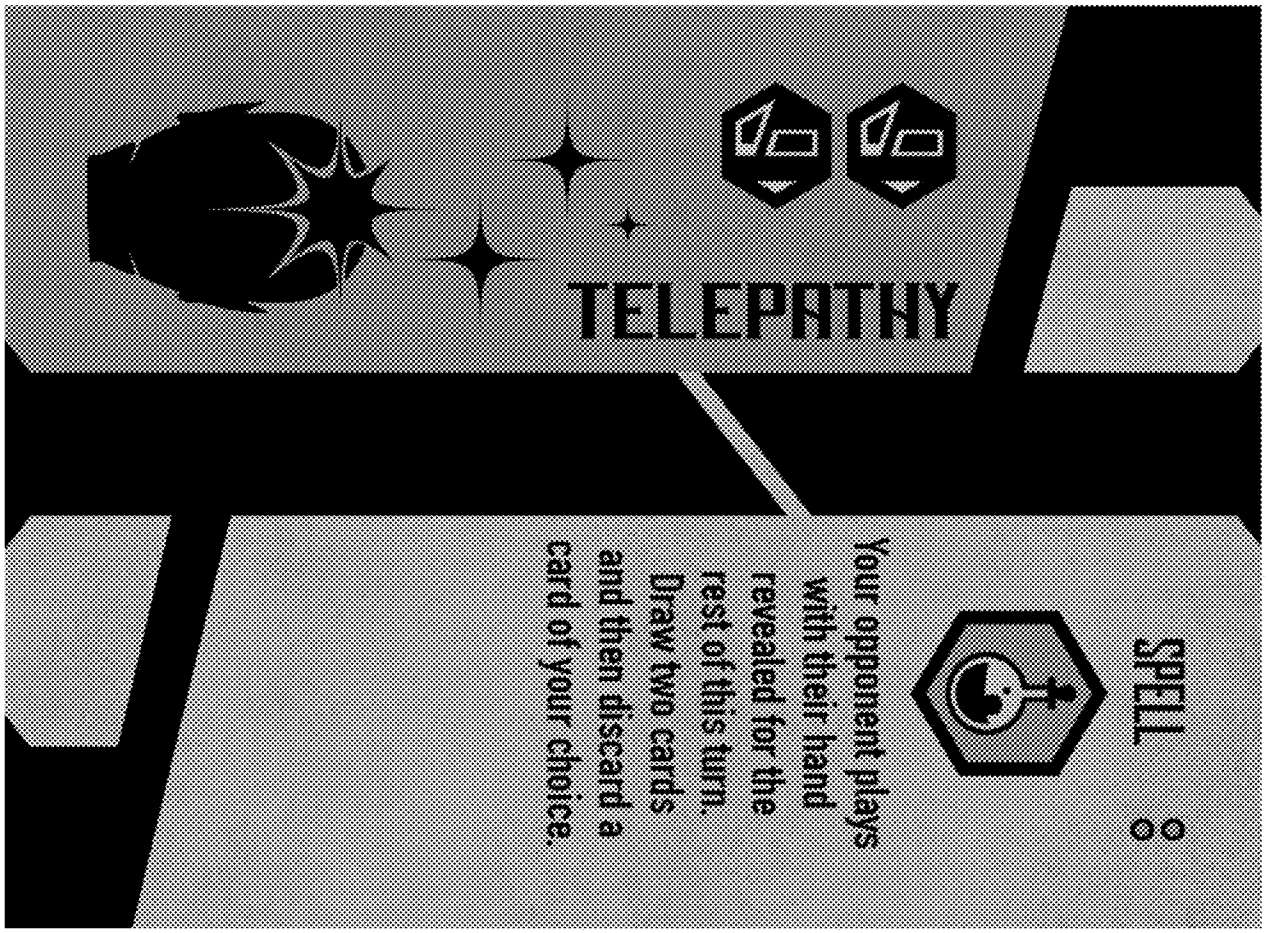
Figure 22:
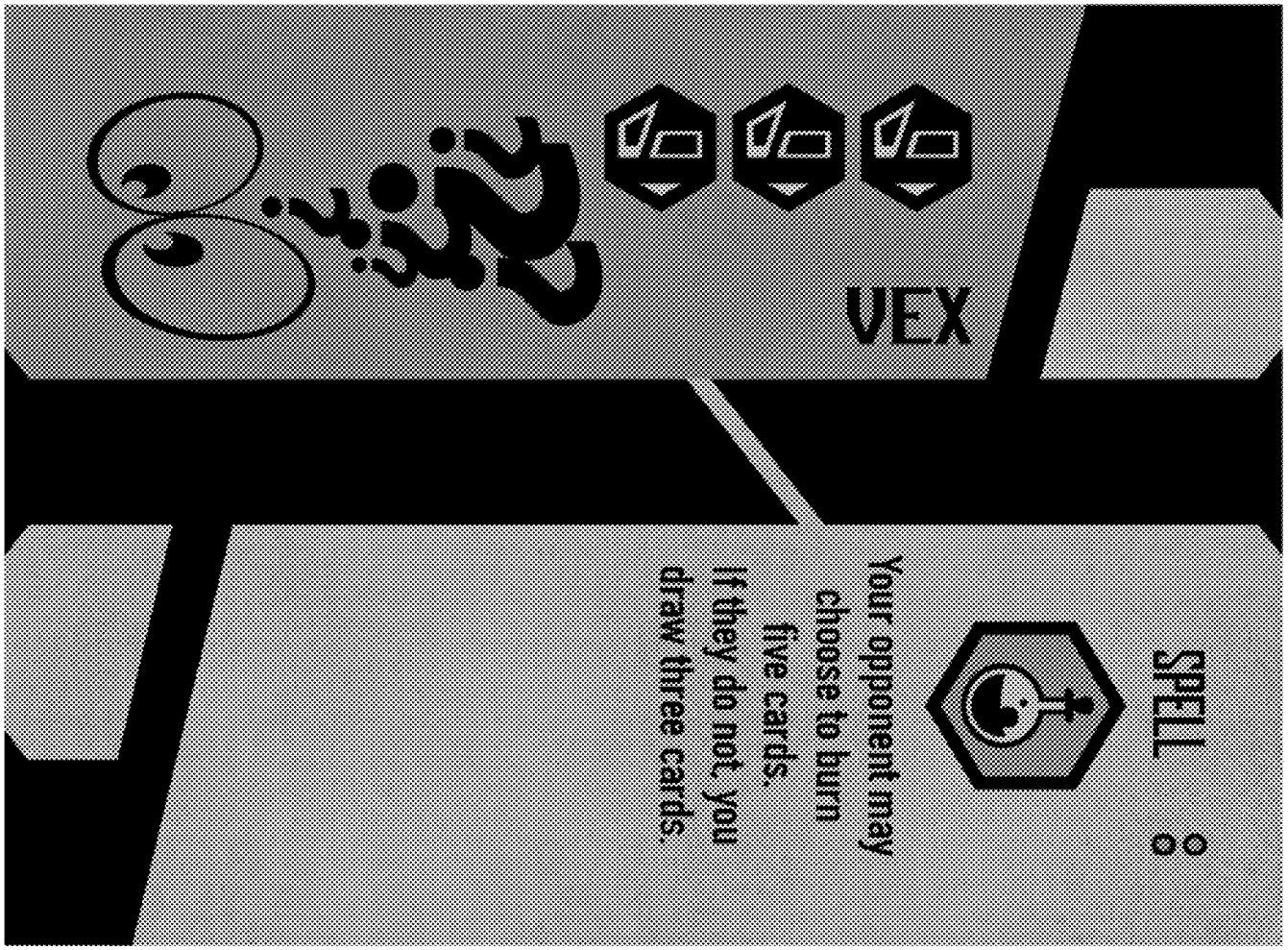
Figure 23:
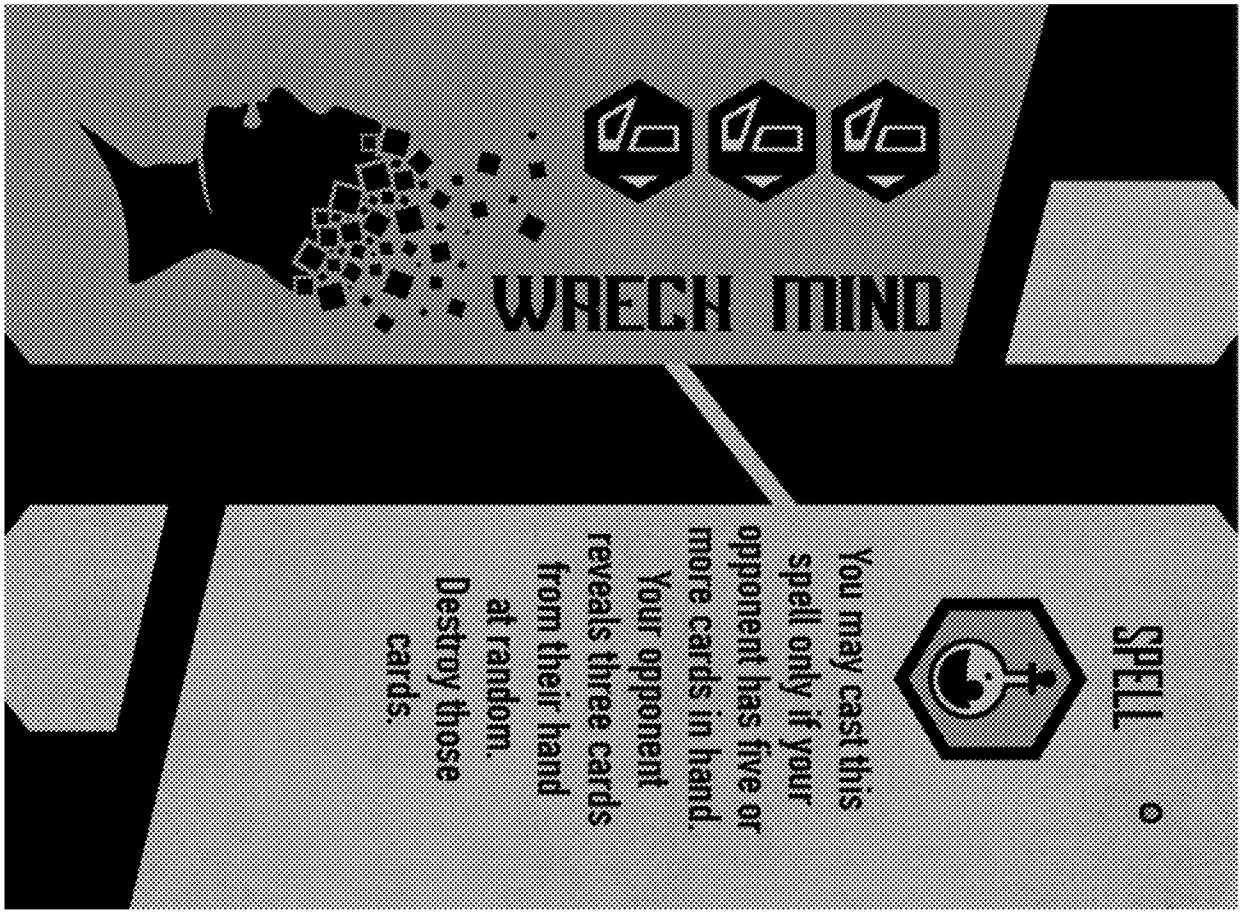

A "revealing-type" spell card instructs the spell recipient to reveal one or more cards from the player's hand to the spell caster. For example, a spell recipient might choose one or more cards to reveal to the spell caster, or the spell caster might choose a card to be revealed at random. An exemplary embodiment also includes a spell called "Drag Down" as shown in FIG. 2, which instructs the spell recipient to reveal his or her player hand, and permits the spell caster to choose a card from the hand to place in the spell recipient's discard pile. An exemplary embodiment also includes a spell called "Wreck Mind" as shown in FIG. 23, which instructs the spell recipient to reveal three cards from the spell recipient's player hand at random and then to destroy those cards by placing them in the burn pile. An exemplary embodiment also includes a spell called "Telepathy" as shown in FIG. 21, which instructs the spell recipient to play with their hand revealed for the duration of the turn along with additional instructions discussed below.

Figure 9:
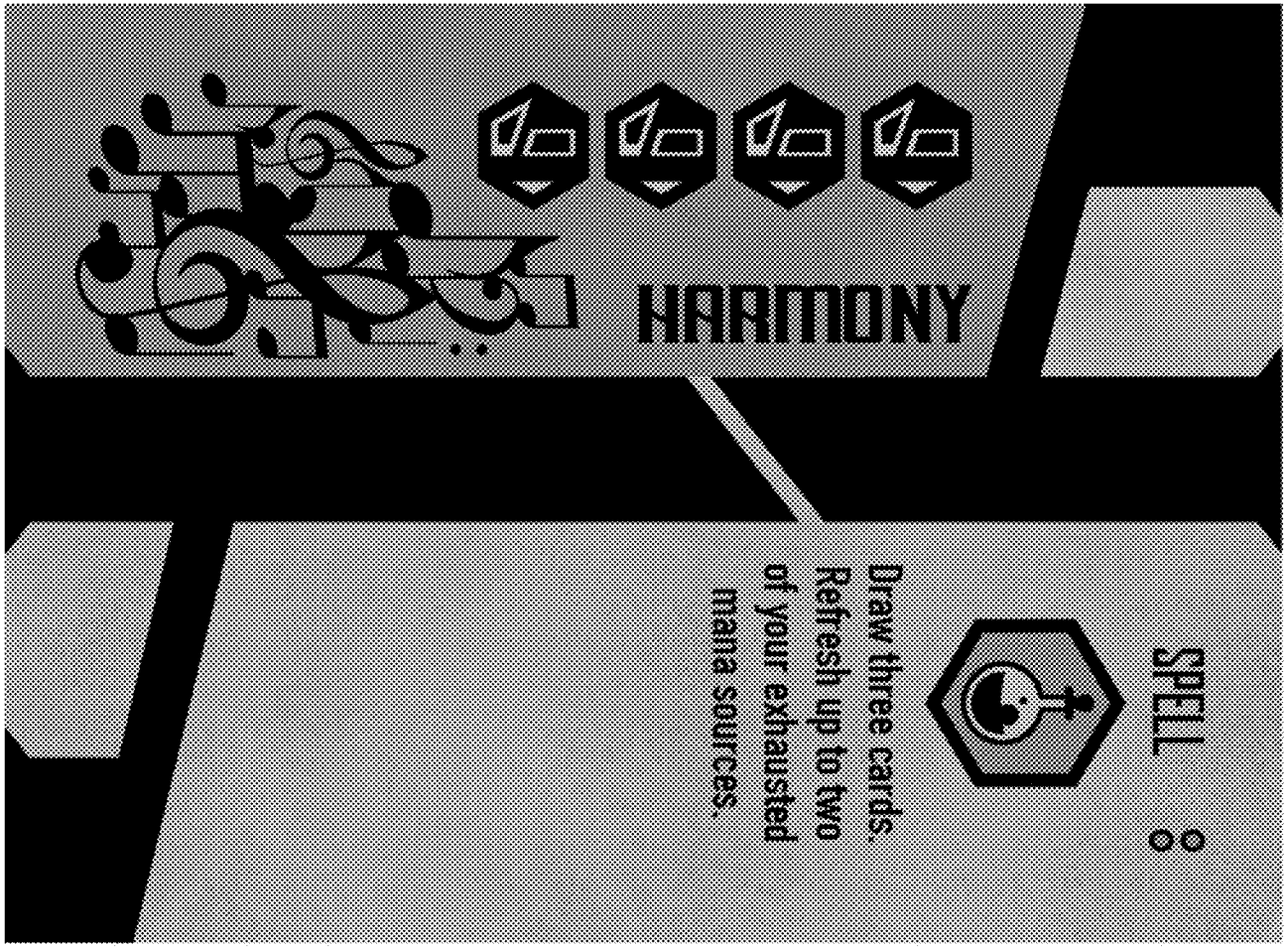
Figure 10:
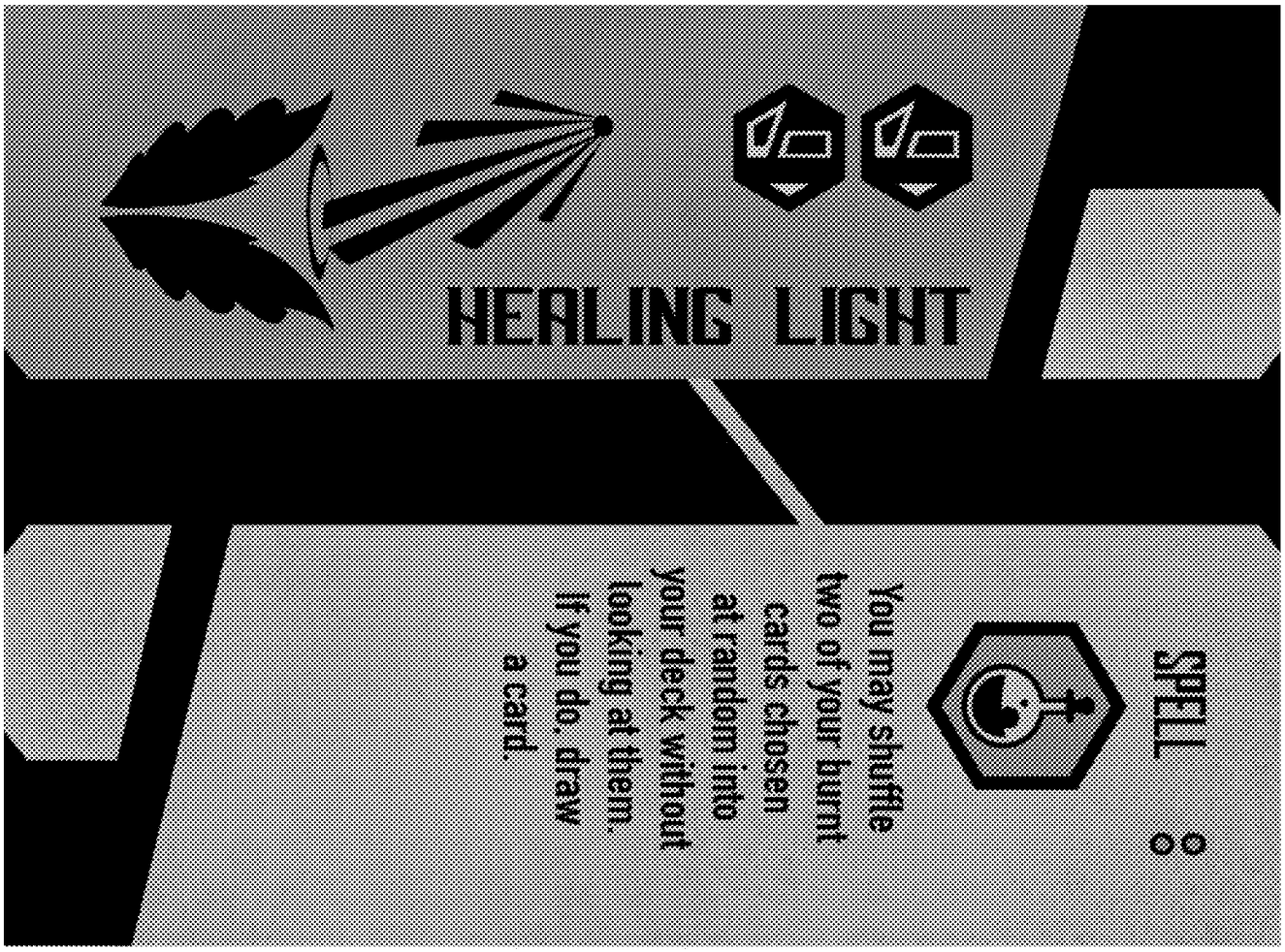
Figure 14:
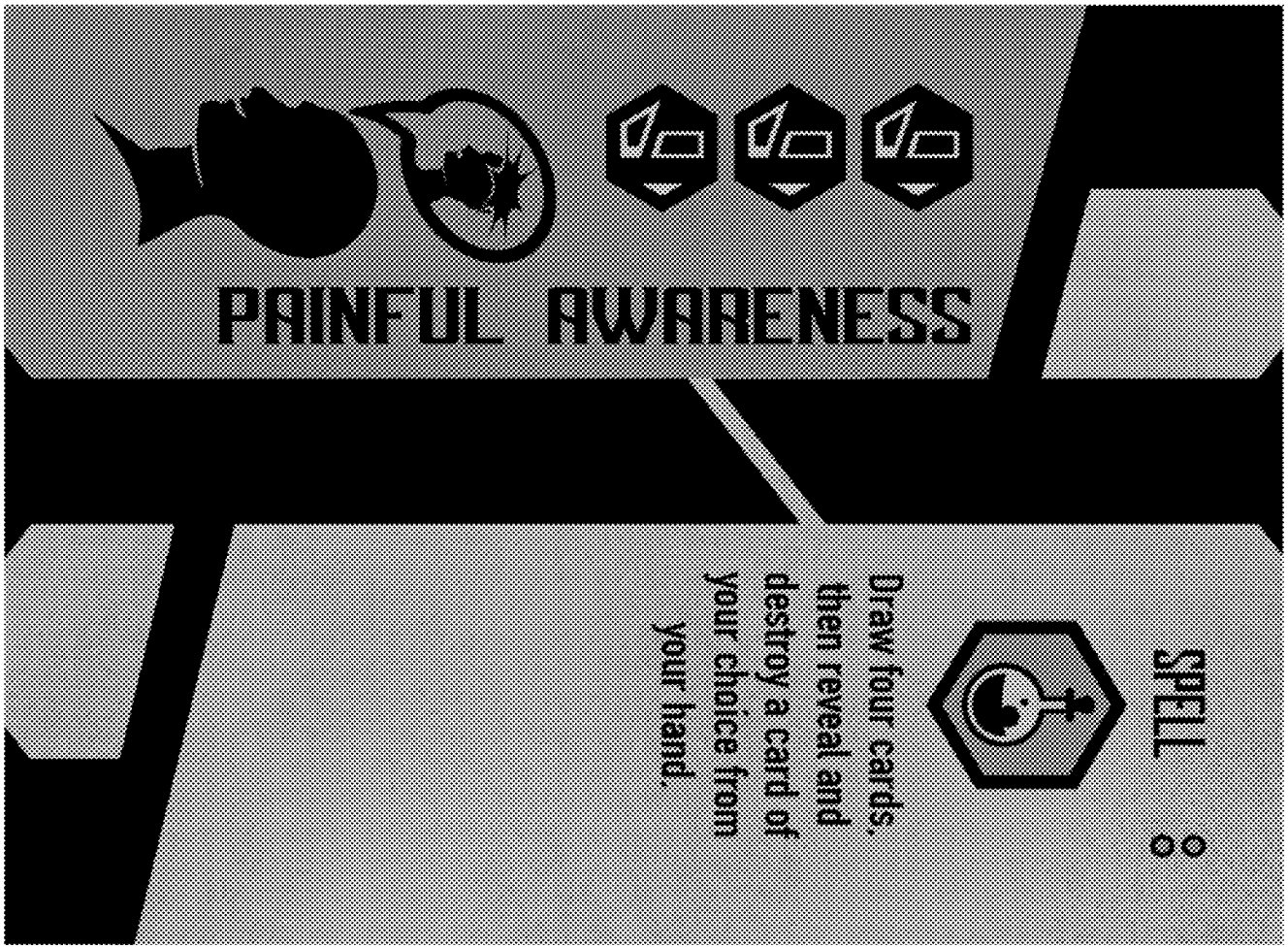
Figure 15:
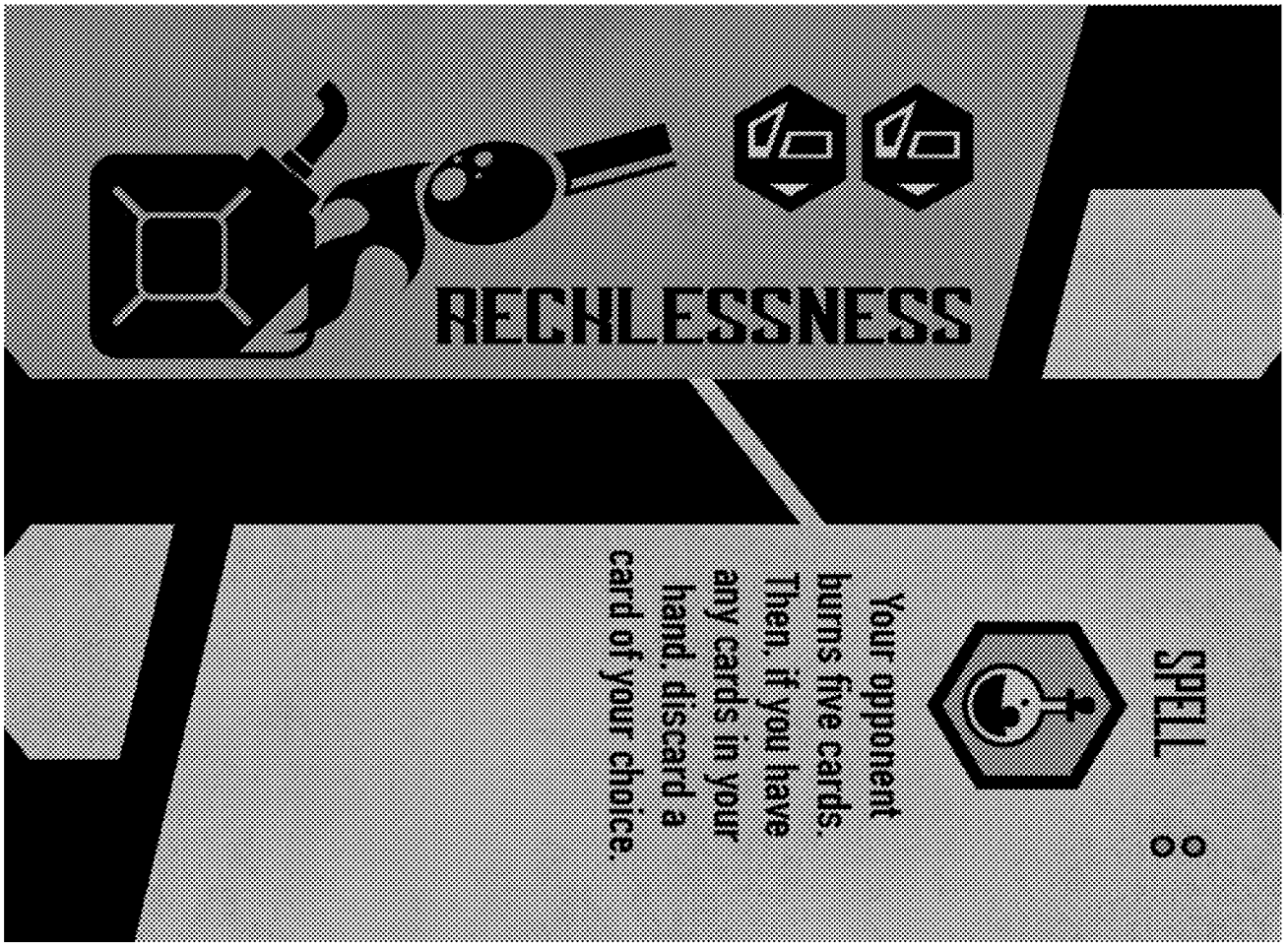
Figure 16:
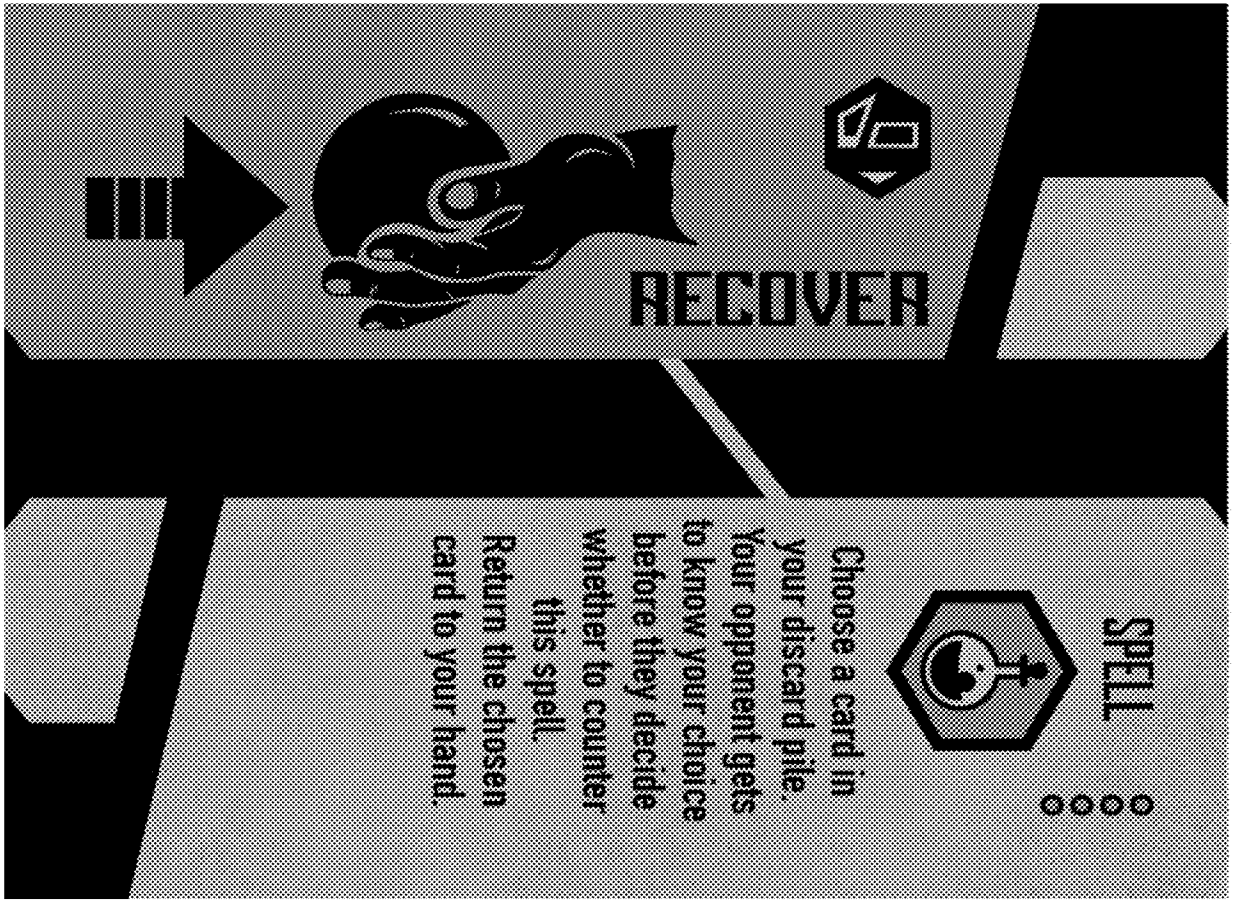
Figure 17:
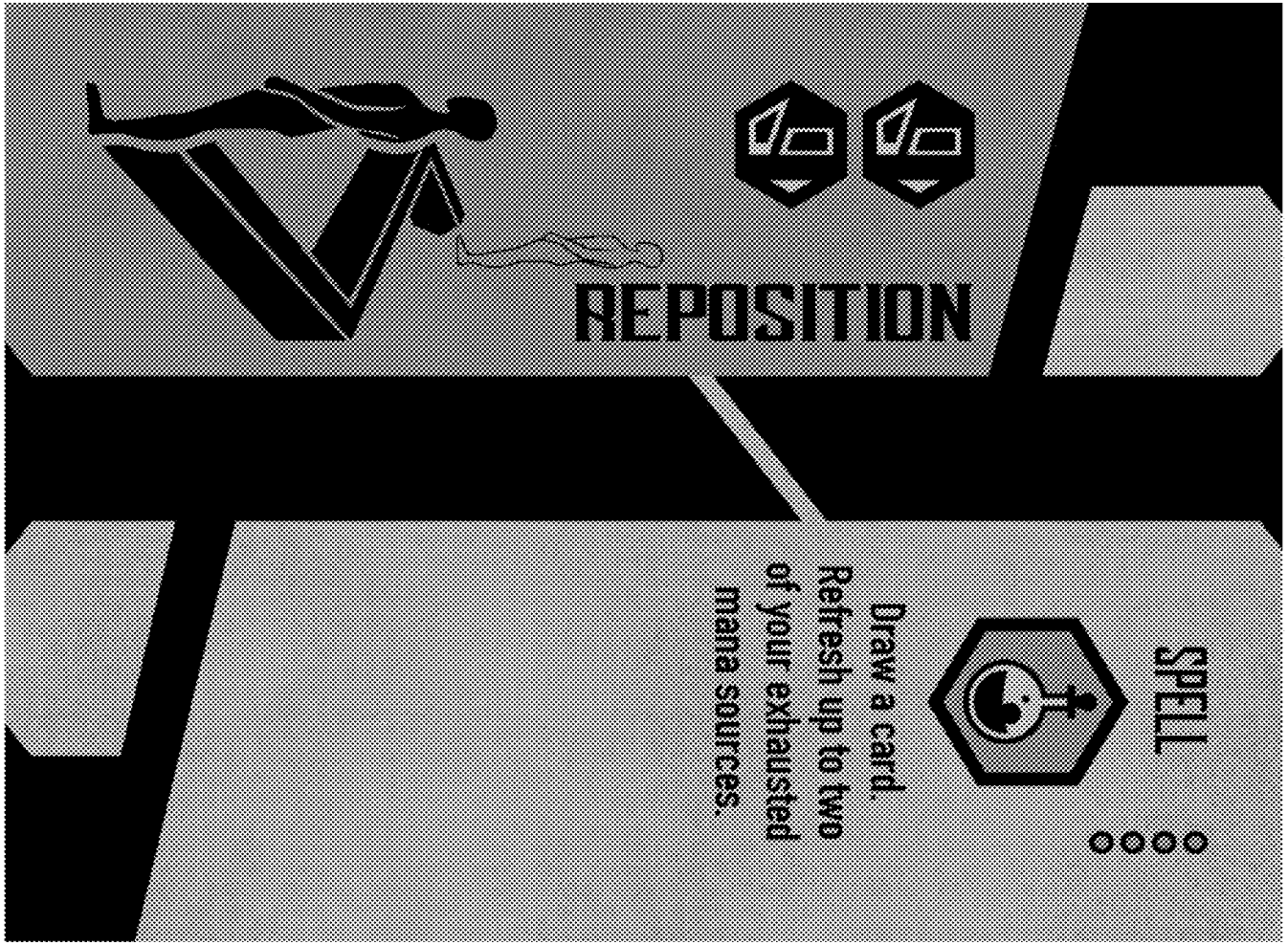

A "draw-type" spell card instructs the spell caster to draw one or more cards from that player's player deck to add to the spell caster's player hand. An exemplary embodiment includes a spell called "Harmony" as shown in FIG. 9, which instructs the spell caster to draw three cards and along with additional instructions discussed below. An exemplary embodiment also includes a spell called "Painful Awareness" as shown in FIG. 14, which instructs a spell caster to draw four cards to add to the spell caster's player hand and then reveal and destroy one card from the player hand by placing it in the burn pile. An exemplary embodiment also includes a spell called "Telepathy" as shown in FIG. 21, which instructs the spell caster to draw two cards and then discard one card from the spell caster's player hand by placing it in the discard pile, along with other instructions previously discussed.

A "heal-type" spell card permits the spell caster to recover one or more cards from the burn pile that had been removed from the spell caster's player deck. According to an exemplary embodiment, playing a heal-type spell card is the only way that cards from a player's burn pile may be recovered and re-used during the game. An exemplary embodiment also includes a spell called "Second Wind" as shown in FIG. 18, which instructs the spell caster to place four cards from the burn pile chosen at random on the bottom of the spell caster's player deck.

An "enhance-type" spell card amplifies the effect of a future played spell card. For example, an enhance-type spell card might double the effect of a subsequent burning-type spell card, such that the spell recipient would be required to burn double the number of cards specified by the burning-type spell card. An exemplary embodiment includes a spell called "Ascension" as shown in FIG. 1, which instructs the spell caster that the next spell cast during the turn has its effect duplicated unless it is countered.

Figure 13:
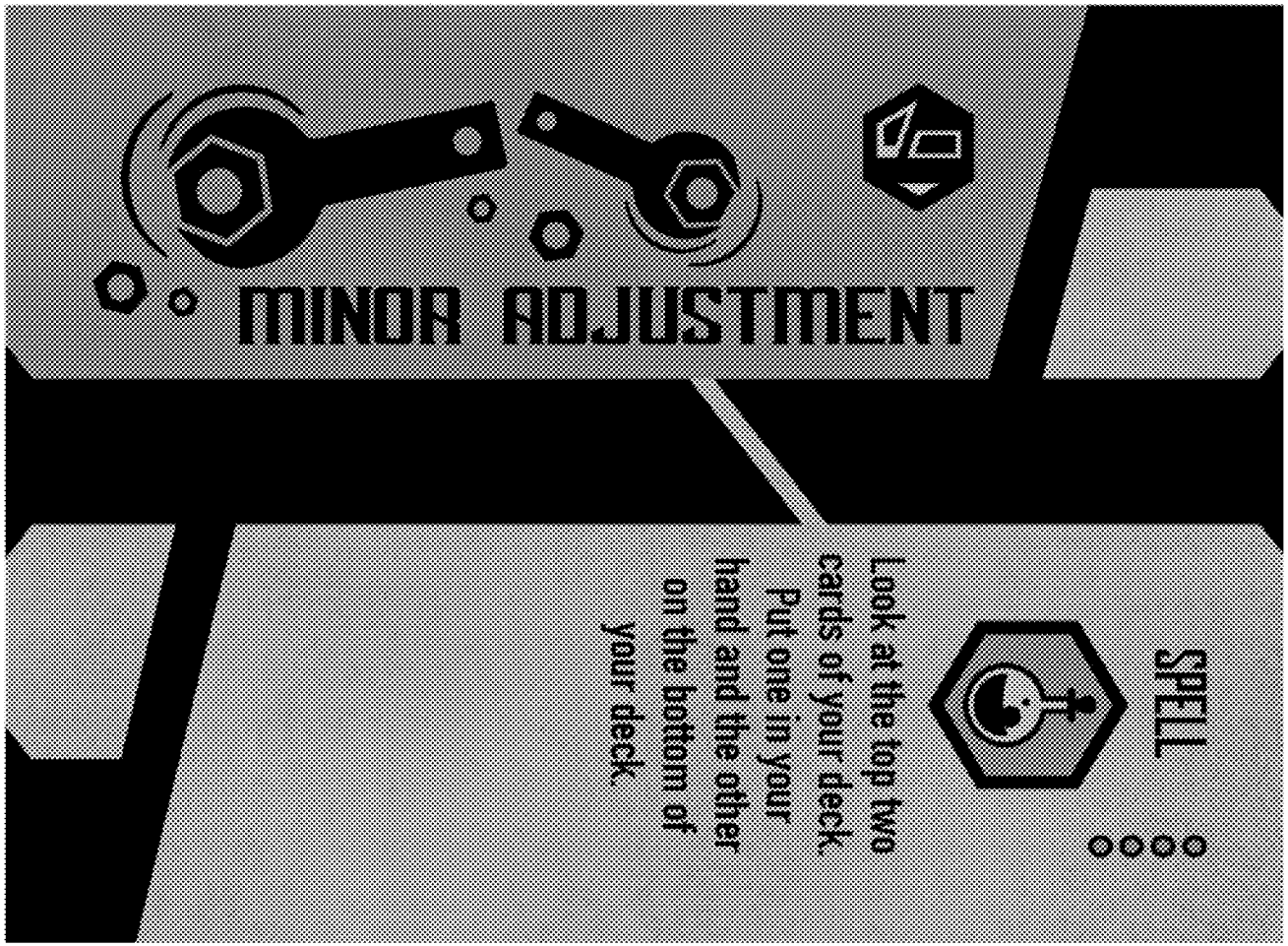

An "adjustment-type" spell card instructs the spell recipient to view a plurality of cards from the spell recipient's player deck, add one or more cards to the spell recipient's player hand, and place the remaining cards on the bottom of the spell recipient's player deck. An exemplary embodiment also includes a spell called "Minor Adjustment" as shown in FIG. 13, which instructs the spell caster to look at the top two cards in the spell caster's player deck and choose one to be added to the spell caster's player hand and place the other on the bottom of the player deck.

Figure 11:
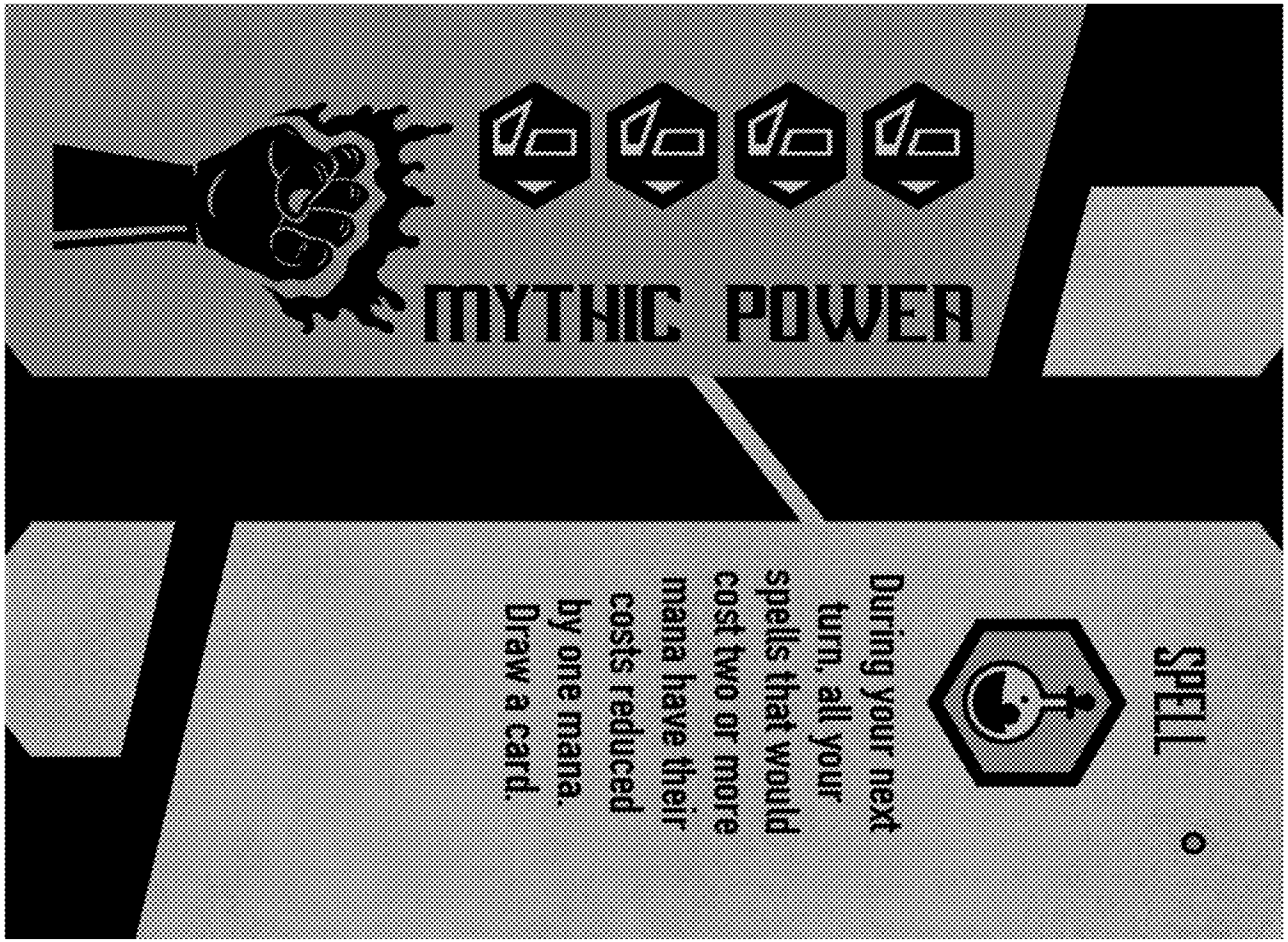

A "reduction-type" spell card reduces the quantity of required mana resources for subsequently played spell cards. For example, a reduction-type spell card might permit the player using it to subsequently cast spells while only imposing one half of the normal cost of mana resources, such that a spell that normally requires and consumes four mana resources will, instead, only requires two. An exemplary embodiment includes a spell called "Mythic Power" as shown in FIG. 11, which instructs that, on the spell caster's next turn, all spells that would cost two or more mana have their mana resource cost reduced by one mana.

Figure 8:
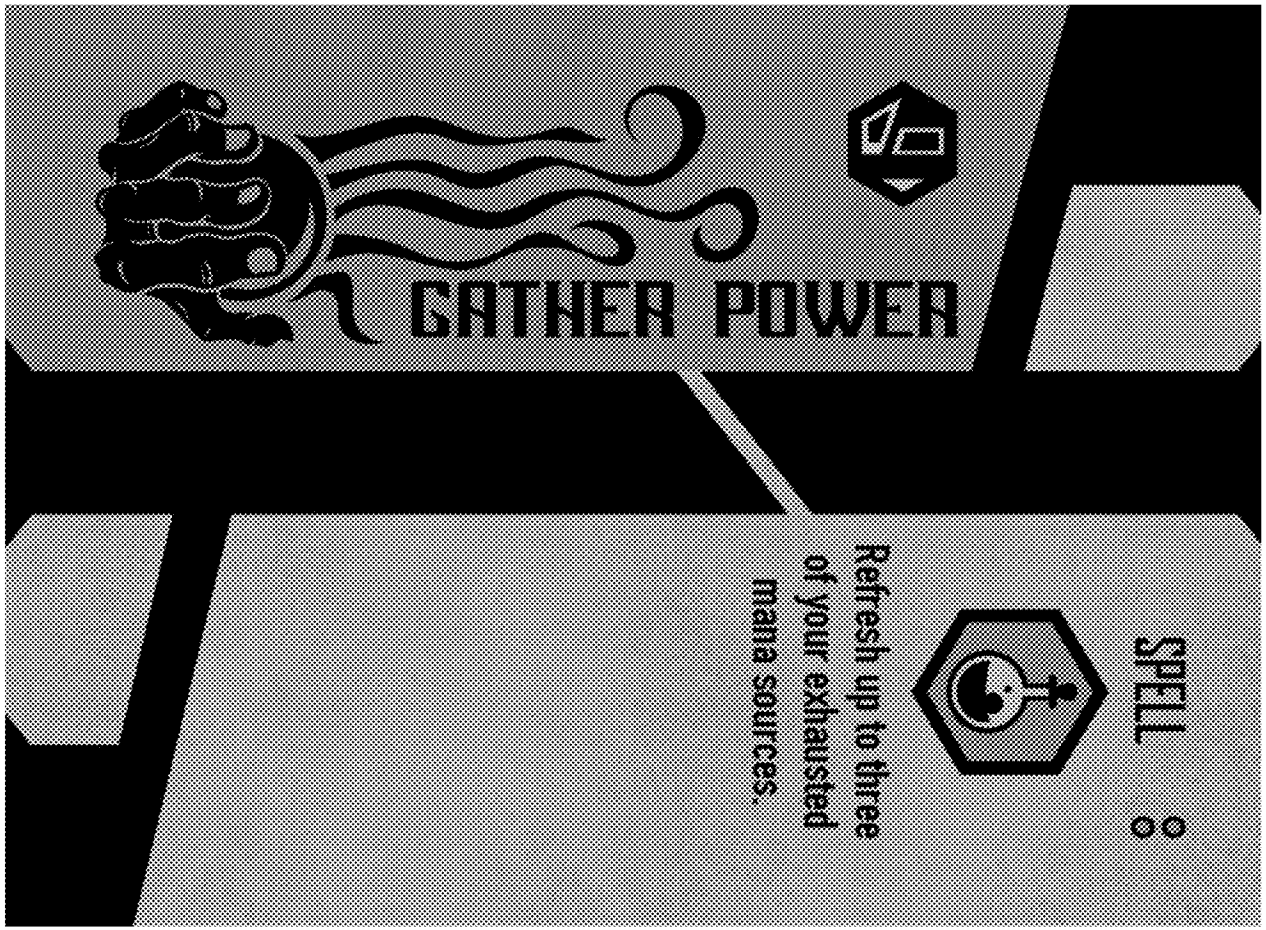

A "refresh-type" spell card refreshes exhausted mana resources during a player's turn. An exemplary embodiment includes a spell called "Gather Power" as shown in FIG. 8, which instructs the spell caster to refresh up to three exhausted mana sources. An exemplary embodiment also includes a spell called "Harmony" as shown in FIG. 9, which instructs a spell caster to refresh up to two exhausted mana resources along with additional instructions discussed previously.

Finally, a combination-type spell card combines the instructions of two or more of any of the previously mentioned following types of spell cards. For example, two or more of the burning-type, discarding-type, draw-type, heal-type, enhance-type, adjustment-type, refresh-type, and revealing-type spell card characteristics may be combined in a single spell card. An exemplary embodiment includes a spell called "Second Wind" as shown in FIG. 18, which is a combination of a burning-type and a heal-type spell card and instructs the spell recipient to burn four cards, but also instructs the spell caster to add four burnt cards chosen at random to the bottom of the spell caster's player deck. An exemplary embodiment also includes a spell called "Harmony" as shown in FIG. 9, which combines the effects of a draw-type and a refresh-type spell card. An exemplary embodiment also includes a spell called "Telepathy" as shown in FIG. 21, which combines the effects of a draw-type and a revealing-type spell card. An exemplary embodiment also includes a spell called "Mental Assault" as shown in FIG. 12, which combines the effects of a burning-type and a discard-type spell card. Other combinations are possible and their effects may be discussed herein.

Figure 24:
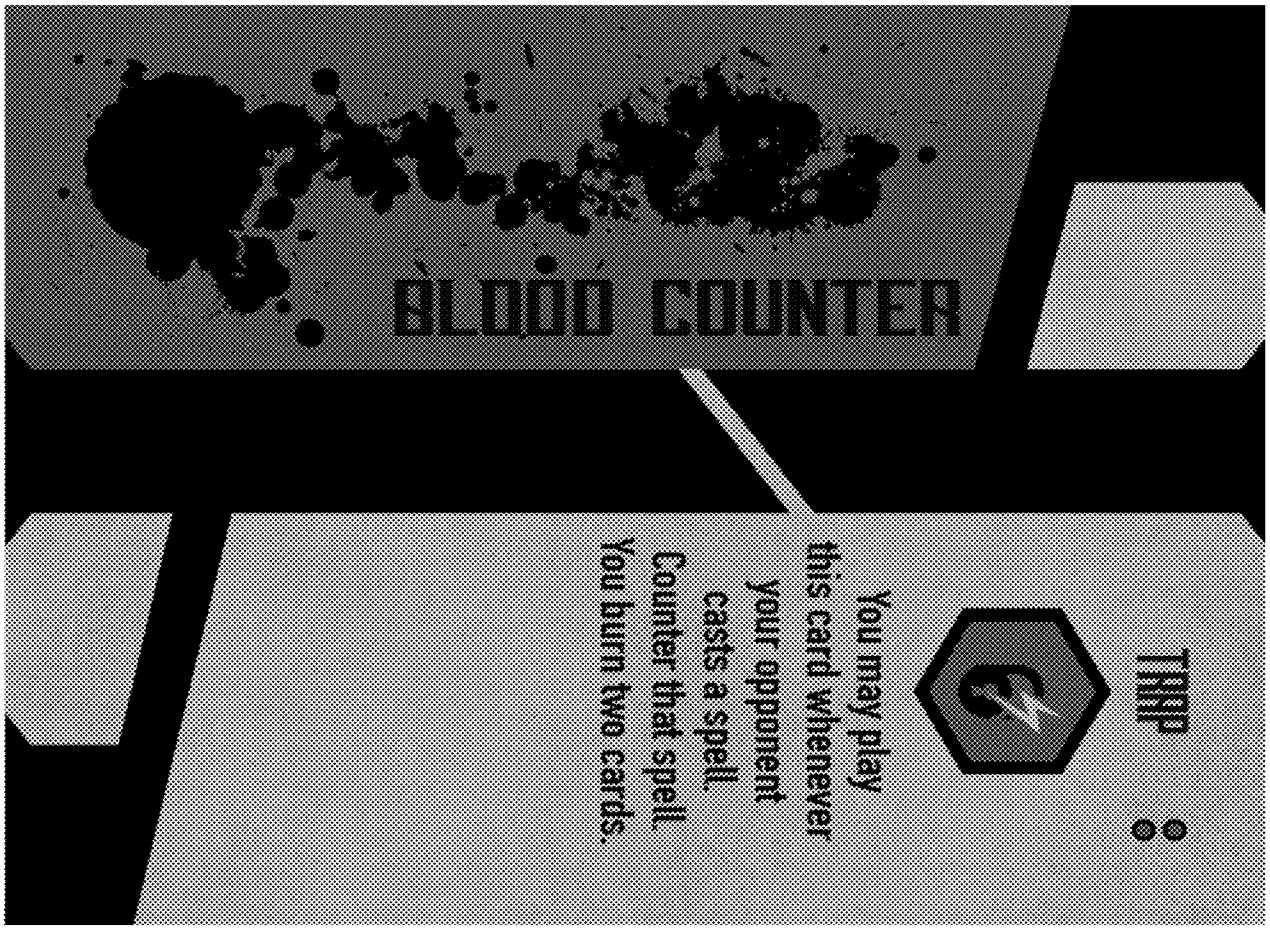
FIGS. 24-28 shows the trap cards that may be used during the game according to an exemplary embodiment.
Figure 28:
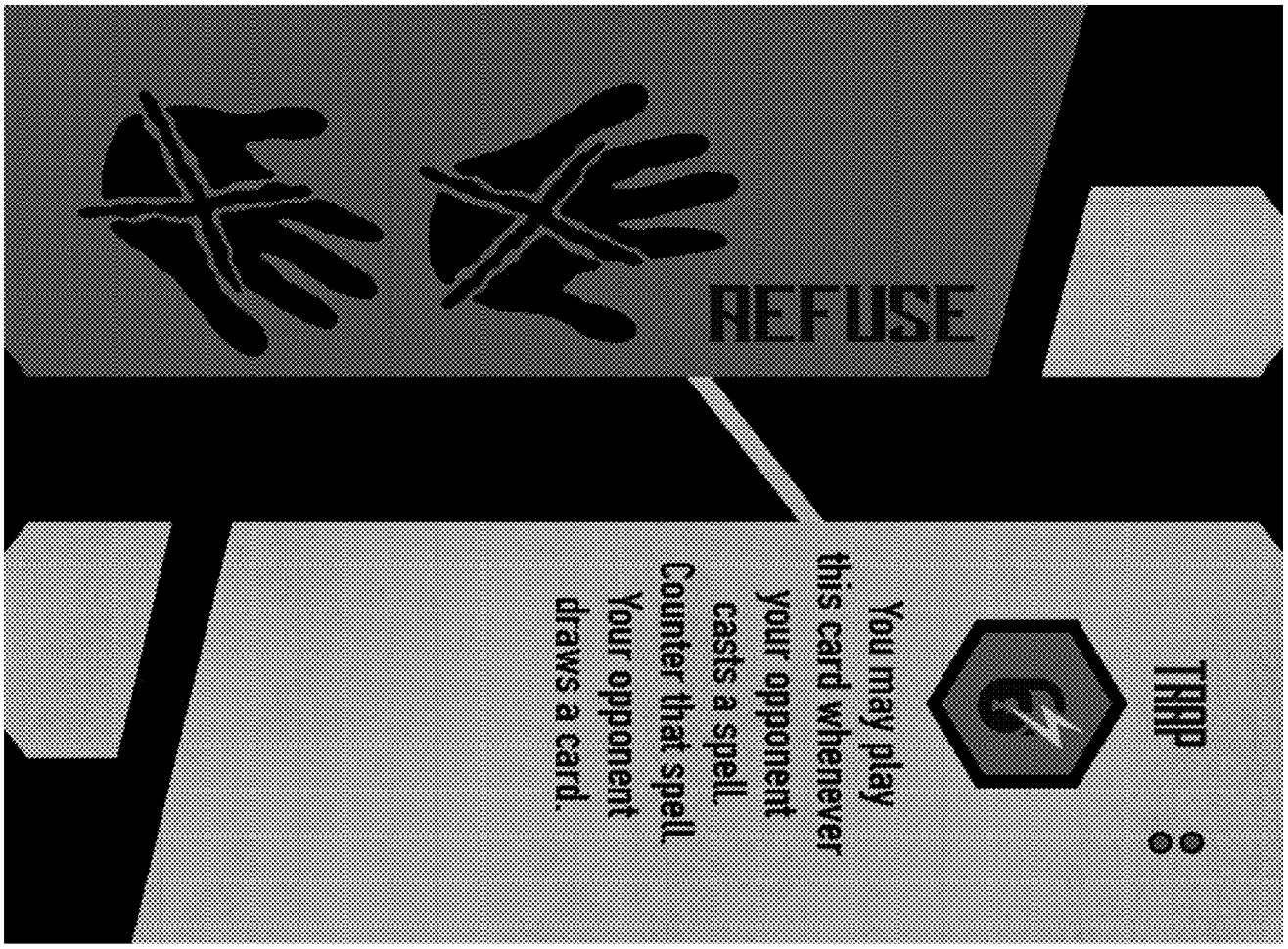

A "drawback-type" trap card allows the trap caster to refuse to follow the instructions on any spell card, but imposes a consequence on the trap caster. Refusing to follow the instructions on a spell card is referred to as "countering" a spell. For example, an exemplary embodiment includes a trap card called "Refuse" as shown in FIG. 28, which counters any spell but also permits the spell caster to draw a card. An exemplary embodiment also includes a trap card called "Blood Counter" as shown in FIG. 24, which counters a spell but requires the trap caster to also burn two cards.

Figure 25:
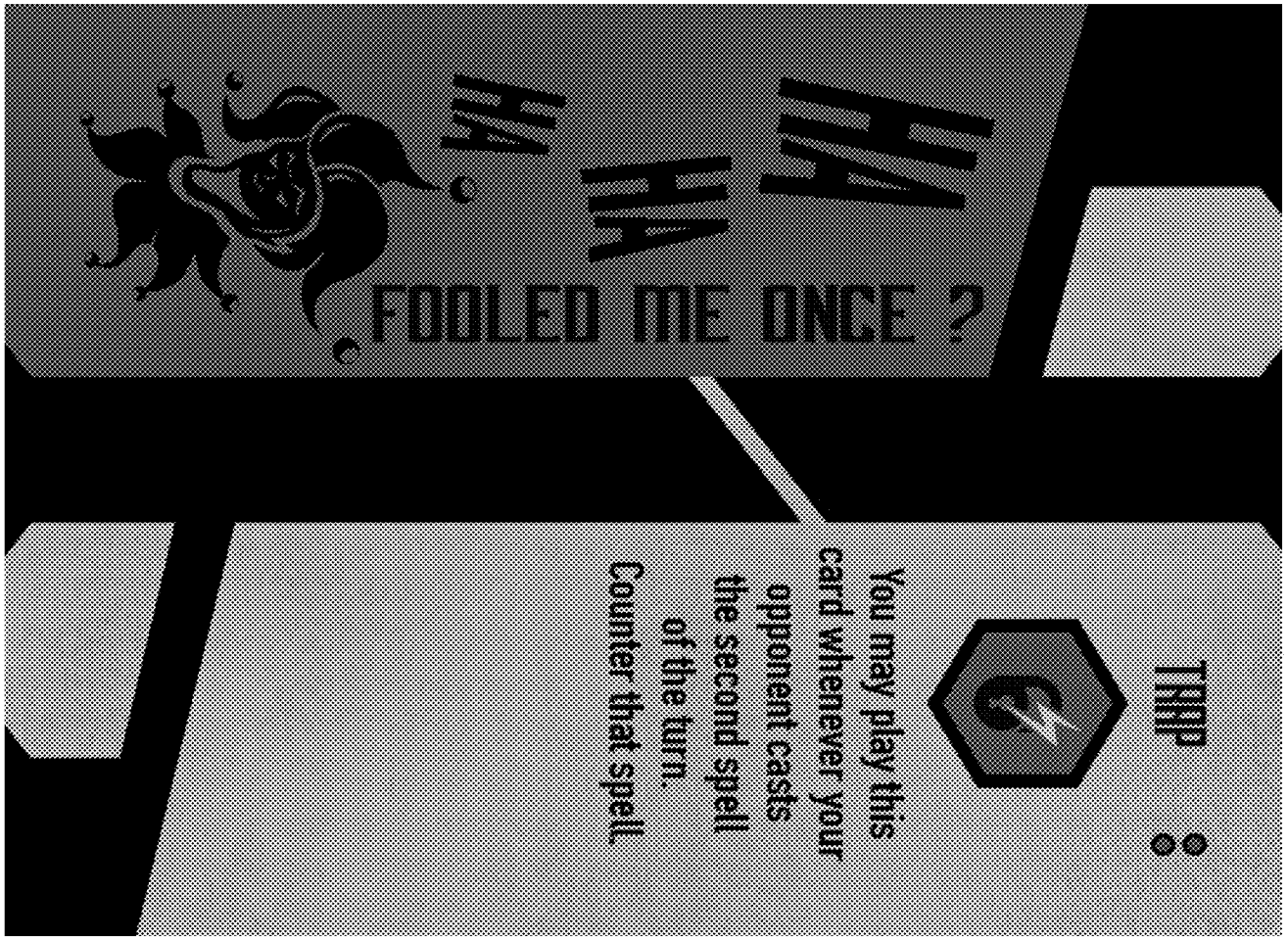
Figure 27:
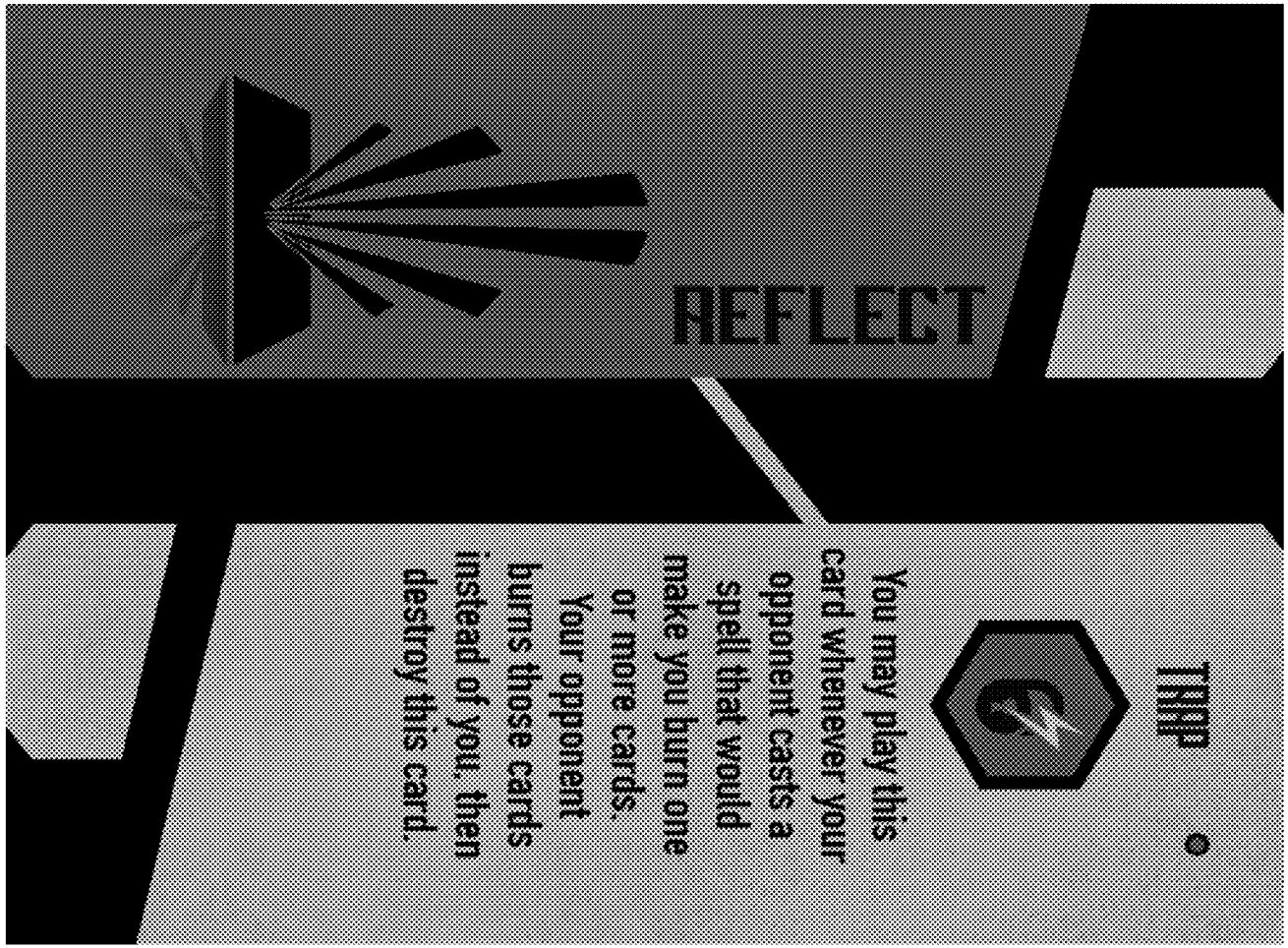

A "situational-type" trap card counters a spell only under certain conditions. For example, an exemplary embodiment includes a trap card called "Fooled Me Once?" as shown in FIG. 25, which counters any spell cast as the second spell of the spell casters turn. An exemplary embodiment also includes a trap card called "Reflect" as shown in FIG. 27, which applies only when the spell caster casts a spell that requires burning cards.

Figure 26:
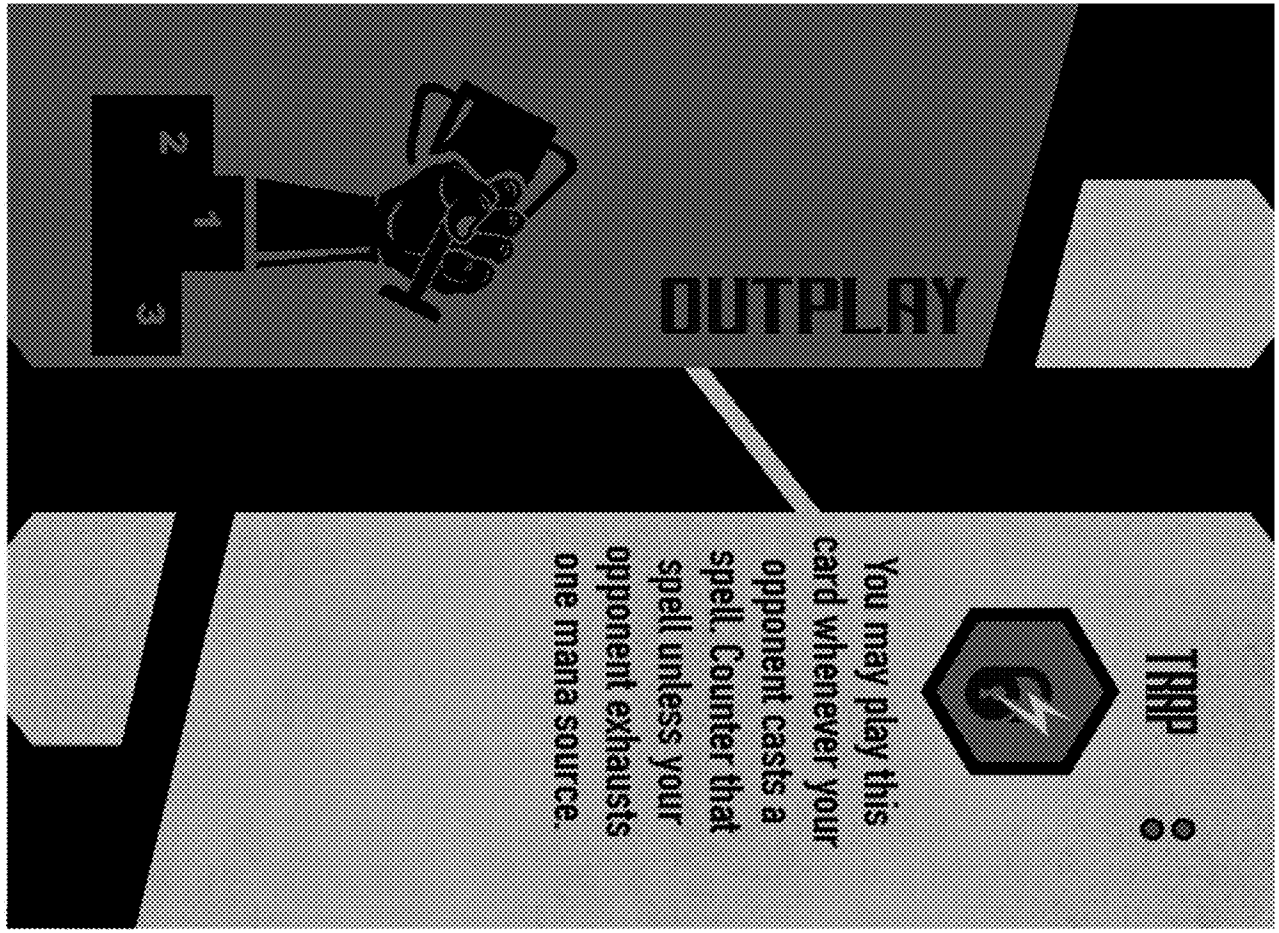

A "resource-type" trap card allows the trap caster/spell recipient to refuse to follow the instructions on any spell card unless the trap recipient/spell caster exhausts at least one additional mana resource. This presents the original spell caster with a choice of either exhausting additional mana resources or abandoning the effects of the spell. If the spell caster is unable or unwilling to exhaust such additional mana resources, then the spell recipient is relieved of any effects of the spell and the spell caster will be unable to benefit from any effects of the spell. An exemplary embodiment includes a trap card called "Outplay" as shown in FIG. 26, which counters a spell unless the spell caster exhausts one additional mana resource.

According to an embodiment of the present invention, the deck of cards includes twenty-three unique spell cards with a total of fifty-seven, achieved by including duplicates and quadruplicates of certain spell cards. Further, according to an embodiment, the deck of cards includes five unique trap cards with a total of nine, making the total number of cards in a deck sixty-six. Each spell card in the described embodiment has four key elements: 1) the card's name; 2) the mana resource cost; 3) the card's effect; and 4) an indicator of the number of times the card is repeated in the deck. Each trap card in the described embodiment has similar elements, except trap cards have no mana resource cost. Although not every possible card is discussed in detail, all cards according to an exemplary embodiment are shown in FIGS. 1-28 with their various instructions shown. As shown, the card's name is written sideways up near the middle of the card, and the instructions are written on the right side of the card which can be appreciated to fall into the various types of cards discussed herein.

Figure 29:
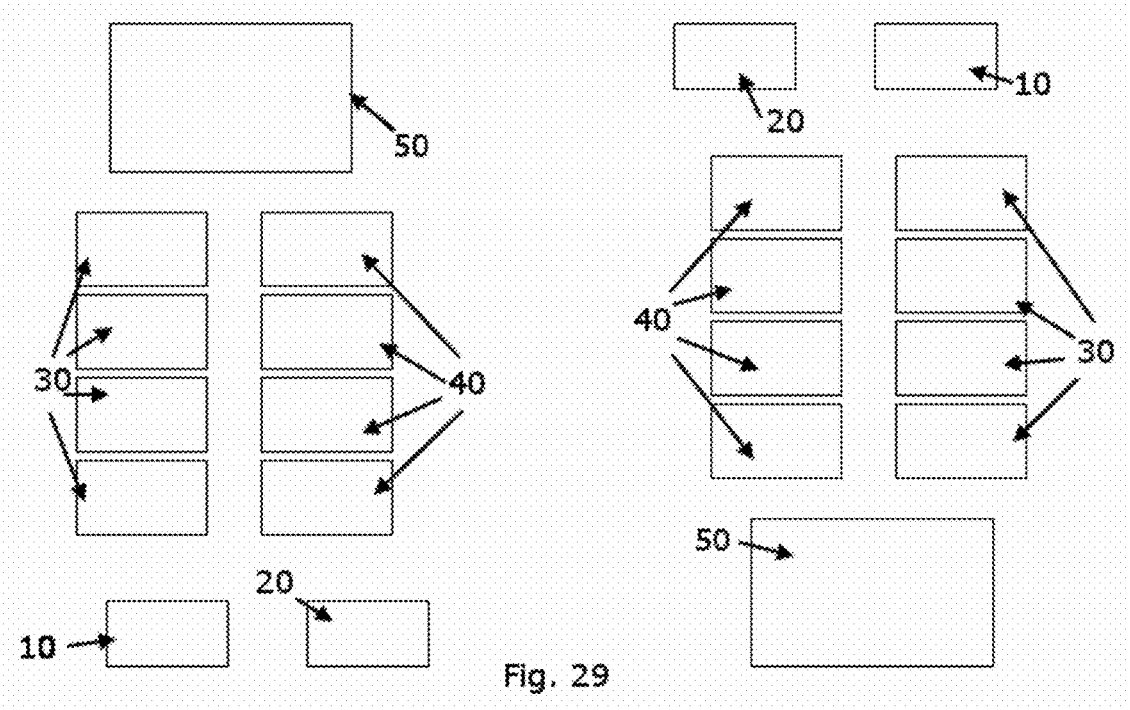
FIG. 29 shows placement of cards throughout the game according to an exemplary embodiment.

A method of playing a card game in accordance with an exemplary embodiment of the invention is described herein, utilizing the deck of cards described above. The placement of cards described within the context of this method is described with reference to FIG. 29, which depicts a playing surface disposed between two opposing players illustrating areas where various cards may be placed to designate their purpose or condition. The game begins by dividing a shuffled deck of the 66 playing cards described herein between the players into individual player decks of 33 cards each. For example, dividing includes dividing the deck of playing cards into equal player decks between two players. Each player deck is then shuffled separately by each player. To determine a starting player, each player reveals only the bottom card of his or her respective deck. The player whose revealed bottom card has a higher mana resource cost is chosen as the starting player. If the revealed cards both have the same mana resource cost, then the cards are re-shuffled and the process is repeated. Since a trap card requires no mana resources, its mana resource cost is zero. The individual player decks could be placed to each respective player's right hand side, nearest to the player in the area designated 10.

The method of playing a card game in accordance with an exemplary embodiment continues with each player drawing a plurality of cards from the top of his or her player deck into a player hand. For example, each player may draw four cards to form a starting player hand. At the beginning of his or her first turn, the starting player then takes a card from the bottom of his or her player deck to represent a mana resource for the duration of the game. The second player will do so as well when his or her turn begins. Each player will do this at the beginning of each turn until they have accumulated cards representing four mana resources, at which point neither player will continue to take from the bottom of the deck and add to their available mana resources. Each mana resource, once taken from the bottom of the deck, may be placed in one of the four available spaces 40 directly in front of each respective player.

Continuing with the starting player's first turn in accordance with an exemplary embodiment, the starting player will then draw one additional card from the top of his or her player deck and add it to his or her player hand. At this point in the game, the starting player has five cards in his or her hand and one available mana resource. The starting player will be permitted to play any spell card with a cost of one mana resource, but no others. The starting player may also choose to cinder by placing any card face down, requiring the spell recipient to burn one card by removing the bottom card from the spell recipient's player deck and placing it in a burn pile. The burn pile may be kept in area 50 to each respective player's left, which keeps it separated from the player deck area 10 and discard pile 20 to avoid confusing cards removed from play with cards still in circulation. Once any spell or cinder cards have resolved their respective abilities, they are placed into the discard pile. Upon the completion of his or her first turn, the starting player will ensure all used spell or cinder cards are in the discard pile and then cede the turn over to the other player. The other player will then proceed with his or her first turn by first taking one card from the bottom of his or her player deck as a mana resource, and then one card from the top of the player deck to add to his or her player hand. The players then alternate turns thereafter.

The method of playing a card game in accordance with an exemplary embodiment continues. As previously discussed, mana resources will continue to be taken from the bottom of each player's respective player deck until each player has taken a total of four cards to represent mana resources. Throughout play, at the beginning of each turn the active player will refresh all of its mana resources exhausted on the previous turn and then draw one additional card from his or her player deck to add to his or her player hand. For example, each player will indicate that all accumulated mana resources are available through the placement and/or orientation of the cards representing the mana resources. Using a gameplay layout illustrated according to an exemplary embodiment in FIG. 29, exhausted mana resources could be indicated by placing the cards representing those mana resources into the spaces 30 closest to where the player would be seated, while available mana resources could be indicated by placing the cards representing those mana resources into the spaces 40 further away from where the player would be seated. Available and exhausted mana resources are indicated by the player throughout his or her turn as they are consumed or refreshed through the use of spell cards.

In accordance with an exemplary embodiment of the invention, when the player plays a card, he or she announces the name of the card to the opponent. In the upper right corner of each card, a user may find the word "spell" or "trap" to inform the players whether the card is a spell card or a trap card. Spell or trap cards may also be distinguished with different colors. In one embodiment, spell cards are blue and trap cards are red. Spell cards can only be played during a user's own turn, whereas trap cards can only be used during the opponent's turn. Lastly, the card's effect is written on the right-hand side. The effect explains what to do when a user plays the card. Once the player announces the name of the spell and places it on the table, the player then indicates a number of mana resources equal to the spell's mana resource cost as being exhausted using any method discussed herein or any method agreeable to the players. The spell recipient must be given an opportunity to respond with a trap card. If the spell recipient does not counter with a trap card, the instructions on the spell card must be performed. After performing this step, the spell card must be put on top of the discard pile face up. Area 20 may be used as a designated area for the discard pile. If a spell puts some of the spell caster's other cards into his or her discard pile, those cards will end up below the spell in the discard pile, since the spell goes in last. In the case of a cinder, according to an embodiment of the invention, the spell recipient will not know what card was used to cinder until after the opponent decides whether or not to counter, and the cinder card is placed on top of the discard pile face up. As a reminder, a "cinder" counts as a spell in that it can be countered and can be affected by other abilities that affect spells.

The method of playing a card game in accordance with an exemplary embodiment continues by replacing the player deck with the cards from the discard pile once the player deck is fully exhausted. In this manner, spell and trap cards that are played throughout the game are recirculated back into the player deck and may be used again. Only by forcing an opponent to burn cards does a player successfully remove spell and trap cards from the deck rotation. When one of the two players is instructed to draw a card from the player deck and is unable to because the player deck is fully exhausted, that player must replace the player deck with the cards that remain in the discard pile. If no cards remain in either of the player's deck or discard pile, that player loses and the game is concluded.

Other rules and methods for playing the game according to an embodiment include answering honestly if an opponent asks for any of the following information: the number of cards in the opponent's deck; the number of cards in the opponent's discard pile; the number of cards in the opponent's hand; and the number of cards in the opponent's burnt cards pile. Additionally, an embodiment of the invention permits a player to look at either player's discard pile, to see which cards are there and what order they are in without changing order of the cards in the discard pile. However, an embodiment of the present invention prohibits a player from looking at the cards in either player's burnt cards pile. According to an embodiment, if a player has insufficient cards remaining to perform certain actions, the following rules may take effect: 1) If a player is directed to discard cards, but does not have enough cards in his or her player hand, then that player discards his or her entire player hand. 2) If a player is directed to burn cards, and there are not enough cards in that player's player deck, that player burns all the cards in the player deck, and then burns cards from the bottom of the discard pile until the required number of cards has been burnt to finish the original effect (i.e. what the card told the player to do). If there are not enough cards in the discard pile, the player's entire discard pile is burnt. 3) If a player is directed to draw or look at cards from their deck, and there are not enough cards in the deck, that player draws or looks at as many cards as possible from their deck, then shuffles their discard pile. This pile is placed face down as that player's new deck. Then that player draws or looks at cards from the new deck up to the number needed to finish the original effect. 4) If a player is directed to look at cards from the top of their deck, and there are not enough cards in the deck and discard pile combined, that player looks at all cards in their deck and discard pile, and finishes the original effect with the available number of cards. 5) If a player is directed to draw cards, and there are not enough cards in the deck and discard pile combined, that player loses the game.

The invention has been described herein with respect to an exemplary embodiment; however, it should be apparent that other variations are possible without departing from the scope of the invention as described in the claims that follow. For example, other embodiments might involve the addition of spell and/or trap cards not yet conceived including of new types. Furthermore, players could agree to play against one another with a player deck specifically constructed from a combination of the cards described here and such additional cards. For example, if each player possessed a 66-card deck, they could each select 44 cards out of their respective decks to use as their player decks for the duration of a game. The remainder of the game could proceed consistently with the exemplary embodiment described herein. In other embodiments, a game could be comprised of one or more games between two players, or a tournament style game involving a plurality of players and games. Additionally, electronic based embodiments of the present invention would also fall within the scope of the present invention, and would be obvious to a person of ordinary skill in the art in light of the present patent specification.

While the embodiments discussed above have been described with respect to a game proceeding between two opponents, other embodiments are possible, such as play proceeding between three or more players. For example, in one such embodiment, three or more players could initiate a game with each possessing a 44 card constructed deck. For any card in the deck that specifies direct consequences imposed on an opponent, the consequences are imposed on the player to the left of the spell caster. Similarly, when responding with a trap card, the first opportunity to play a trap card would go to the player to the spell caster's left. If that player is unwilling or unable to play a trap card, the opportunity would pass to the next player until either a trap card has been played or each player has passed on his or her opportunity. In another embodiment involving three or more players, an active player's spell cards could be played against each other player in a 'round robin' style until each player has exchanged spells and potential traps against each other player. Each player unto which a spell card is played would have the opportunity to counter with a trap card. For example, in a three-way game involving players A, B and C, play could proceed as follows. Player A would cast spell cards against player B. Once complete, Player B would cast spell cards against Player C, followed by Player C casting spell cards against Player A. Once complete, it would be Player A's turn again, but this time Player A would cast spells against Player C. Then Player C would cast spells against Player B, followed by Player B casting spells against Player A to complete the round. In this embodiment, this rotation would repeat until one of the players becomes the first to lose in accordance with the rules described herein. This event could end the game, or play between the two remaining players could continue according to the rules described herein until only one player remains. In yet another embodiment, each player could choose which of the multiple opponents to cast spells against throughout that player's turn, with only the declared opponent having the opportunity to oppose spells with trap cards. In this embodiment, a player may be required to declare only one opponent for the player's entire turn, or he may be permitted to declare an opponent with each new spell card.

While the invention has been described as having a preferred design, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

What is claimed is:

1. A method of playing a card game comprising:

dividing a deck of playing cards between two or more players into individual player decks;

drawing a plurality of cards from the top of the player deck into a player hand;

taking a card from the bottom of one of the player decks to represent a mana resource for the duration of the game;

further including each player, at the beginning of each player's respective turn, drawing a card from the top of the respective player's player deck to add to the respective player's player hand;

further including an active player playing at least one spell card during the active player's turn and placing the at least one spell card into a discard pile after the spell card resolves its ability;

further including placing at least one card from the active player's opponent's player deck into a burn pile of cards that are not permitted to be used or drawn from for the duration of the game;

further including a spell caster playing a card face-down to inflict consequences to a spell recipient different than the consequences written on a face of the card; and wherein the card played face-down is a spell card;

wherein the spell card played face-down imposes a mana resource cost onto the spell caster less than the mana resource cost indicated on the face of the card.

2. The method according to claim 1 wherein the spell card played face-down imposes no mana resource cost onto the spell caster.

3. A deck of playing cards for playing a card game comprising:

a plurality of spell cards for offensive use by a player to inflict consequences to the player's opponent; and a plurality of trap cards for defensive use in response to one of the plurality of spell cards used by the player to mitigate consequences thereof;

wherein the spell cards and trap cards are intended to be combined and mixed into a single deck and subsequently divided into player decks and distributed between the players;

wherein the use of spell cards is limited by a mana resource cost associated therewith and a corresponding mana resource availability of a spell caster desiring to use said spell cards;

wherein a plurality of cards in each player deck are removed from their respective player decks and used by each player to indicate available mana resources and exhausted mana resources;

wherein the removed cards are used to keep track of available and exhausted mana resources; and wherein the type of at least one of the removed cards is unknown to the players.

4. The deck of playing cards according to claim 3 wherein each player deck is intended to be drawn from by each respective player to form a player hand for each player.

5. The deck of playing cards according to claim 3 wherein the spell cards include at least one burning-type spell card that instructs a spell recipient to place at least one card from the player deck into a burn pile of cards that are not permitted to be used or drawn from for the duration of the game.

6. The deck of playing cards according to claim 3 wherein the spell cards include at least one discarding-type spell card that instructs a spell recipient to place cards from the player hand into a discard pile of cards that are permitted to be used later in the duration of the game.

7. The deck of playing cards according to claim 3 wherein the spell cards include at least one revealing-type spell card that instructs a spell recipient to reveal at least one card from the player's hand to a spell caster.

8. The deck of playing cards according to claim 3 wherein the spell cards include at least one draw-type spell card that instructs a spell caster to draw one or more cards from the spell caster's player deck to add to the spell caster's player hand.

9. The deck of playing cards according to claim 3 wherein the spell cards include at least one heal-type spell card that permits a spell caster to recover one or more cards that had been removed from the spell caster's player deck.

10. The deck of playing cards according to claim 3 wherein the spell cards include at least one enhance-type spell card that amplifies the effect of a future played spell card.

11. The deck of playing cards according to claim 3 wherein the spell cards include at least one adjustment-type spell card that instructs the spell caster to view a plurality of cards from the spell caster's player deck, add one or more cards to the spell caster's player hand, and place the remaining cards on the bottom of the spell caster's player deck.

12. The deck of playing cards according to claim 3 wherein the spell cards include at least one reduction-type spell card that reduces the quantity of required mana resources for subsequently played spell cards.

13. The deck of playing cards according to claim 3 wherein the spell cards include at least one combination-type spell card that combines the instructions of two or more of the following types of spell cards: burning-type, discarding-type, draw-type, heal-type, enhance-type, adjustment-type, reduction-type and revealing-type.

14. The deck of playing cards according to claim 3 wherein each spell card specifies a number of required mana resources required to play that spell card.

15. A deck of playing cards for playing a card game comprising:

a plurality of spell cards for offensive use by a player to inflict consequences to the player's opponent;

a plurality of trap cards for defensive use in response to one of the plurality of spell cards used by the player to mitigate consequences thereof;

wherein the spell cards and trap cards are intended to be combined and mixed into a single deck and subsequently divided into player decks and distributed between the players;

wherein the use of spell cards is limited by a mana resource cost associated therewith and a corresponding mana resource availability of a spell caster desiring to use said spell cards;

wherein a plurality of cards in each player deck are removed from their respective player decks and used by each player to indicate available mana resources and exhausted mana resources;

wherein each spell card specifies a number of required mana resources required to play that spell card; and wherein the number of required mana resources for each of the spell cards is between one and four.

16. A deck of playing cards for playing a card game comprising:

a plurality of spell cards for offensive use by a player to inflict consequences to the player's opponent; and a plurality of trap cards for defensive use in response to one of the plurality of spell cards used by the player to mitigate consequences thereof;

wherein the spell cards and trap cards are intended to be combined and mixed into a single deck and subsequently divided into player decks and distributed between the players;

wherein the use of spell cards is limited by a mana resource cost associated therewith and a corresponding mana resource availability of a spell caster desiring to use said spell cards;

wherein a plurality of cards in each player deck are removed from their respective player decks and used by each player to indicate available mana resources and exhausted mana resources; and wherein the trap cards include at least one drawback-type trap card that allows a trap caster to refuse to follow the instructions on any spell card and inflict a consequence on the trap caster.

17. The deck of playing cards according to claim 3 wherein the trap cards include at least one situational-type trap card that may only be played to counter spells under specified conditions.

18. A deck of playing cards for playing a card game comprising:

a plurality of spell cards for offensive use by a player to inflict consequences to the player's opponent; and a plurality of trap cards for defensive use in response to one of the plurality of spell cards used by the player to mitigate consequences thereof;

wherein the spell cards and trap cards are intended to be combined and mixed into a single deck and subsequently divided into player decks and distributed between the players;

wherein the use of spell cards is limited by a mana resource cost associated therewith and a corresponding mana resource availability of a spell caster desiring to use said spell cards;

wherein a plurality of cards in each player deck are removed from their respective player decks and used by each player to indicate available mana resources and exhausted mana resources; and wherein the trap cards include at least one situational-type trap card that may only be played to counter spells under specified conditions;

wherein the at least one situational-type trap card applies only to the second spell of the spell caster's turn.

19. A deck of playing cards for playing a card game comprising:

a plurality of spell cards for offensive use by a player to inflict consequences to the player's opponent; and a plurality of trap cards for defensive use in response to one of the plurality of spell cards used by the player to mitigate consequences thereof;

wherein the spell cards and trap cards are intended to be combined and mixed into a single deck and subsequently divided into player decks and distributed between the players;

wherein the use of spell cards is limited by a mana resource cost associated therewith and a corresponding mana resource availability of a spell caster desiring to use said spell cards;

wherein a plurality of cards in each player deck are removed from their respective player decks and used by each player to indicate available mana resources and exhausted mana resources;

wherein the trap cards include at least one situational-type trap card that may only be played to counter spells under specified conditions; and wherein the at least one situational-type trap card applies only to counter a specific type of spell card.

20. A deck of playing cards for playing a card game comprising:

a plurality of spell cards for offensive use by a player to inflict consequences to the player's opponent; and a plurality of trap cards for defensive use in response to one of the plurality of spell cards used by the player to mitigate consequences thereof;

wherein the spell cards and trap cards are intended to be combined and mixed into a single deck and subsequently divided into player decks and distributed between the players;

wherein the use of spell cards is limited by a mana resource cost associated therewith and a corresponding mana resource availability of a spell caster desiring to use said spell cards;

wherein a plurality of cards in each player deck are removed from their respective player decks and used by each player to indicate available mana resources and exhausted mana resources; and wherein the trap cards include at least one resource-type trap card that allows a trap caster to refuse to follow the instructions on any spell card unless a trap recipient exhausts at least one additional mana resource.

21. The deck of playing cards according to claim 3 wherein the card game is concluded when one of the players has an insufficient number of cards in the player deck to draw when required to draw one or more cards.

22. The deck of playing cards according to claim 3 wherein the quantity of unique spell cards is twenty three and the total quantity of spell cards is fifty seven.

23. The deck of playing cards according to claim 3 wherein the quantity of unique trap cards is five and the total quantity of trap cards is nine.

24. The deck of playing cards according to claim 3 wherein at least one of the cards in the deck of cards is implemented electronically.

25. The deck of playing cards according to claim 3 wherein at least one of the plurality of spell or trap cards may be played face-down by a spell caster as a spell to inflict consequences to a spell recipient different than the consequences written on a face of the card.

26. The deck of playing cards according to claim 25 wherein the at least one card is a trap card.

27. The deck of playing cards according to claim 25 wherein the at least one card is a spell card.

28. A deck of playing cards for playing a card game comprising:

a plurality of spell cards for offensive use by a player to inflict consequences to the player's opponent; and a plurality of trap cards for defensive use in response to one of the plurality of spell cards used by the player to mitigate consequences thereof;

wherein the spell cards and trap cards are intended to be combined and mixed into a single deck and subsequently divided into player decks and distributed between the players;

wherein the use of spell cards is limited by a mana resource cost associated therewith and a corresponding mana resource availability of a spell caster desiring to use said spell cards;

wherein a plurality of cards in each player deck are removed from their respective player decks and used by each player to indicate available mana resources and exhausted mana resources;

wherein at least one of the plurality of spell or trap cards may be played face-down by a spell caster as a spell to inflict consequences to a spell recipient different than the consequences written on a face of the card;

wherein the at least one card is a spell card; and wherein the at least one of the plurality of spell cards imposes a mana resource cost onto the spell caster less than the mana resource cost indicated on the face of the card when played face-down.

29. The deck of playing cards according to claim 28 wherein the at least one of the plurality of spell cards imposes no mana resource cost onto the spell caster when played face-down.

30. The deck of playing cards according to claim 25 wherein any of the plurality of spell cards or any of the plurality of trap cards may be played face-down by the spell caster to instruct the spell recipient to place at least one card from the player deck into a burn pile of cards that are not permitted to be used or drawn from for the duration of the game.

* * * * *